US008439989B2

(12) United States Patent
Baldrey et al.

(10) Patent No.: US 8,439,989 B2
(45) Date of Patent: May 14, 2013

(54) ADDITIVES FOR MERCURY OXIDATION IN COAL-FIRED POWER PLANTS

(75) Inventors: Kenneth E. Baldrey, Denver, CO (US); Sharon Sjostrom, Denver, CO (US); Nina Bergan French, Napa, CA (US); Michael D. Durham, Castle Rock, CO (US); Stephen Allen Johnson, Windham, NH (US); John Wurster, Evergreen, CO (US); John Philip Comer, Manchester, NH (US)

(73) Assignee: ADA-ES, Inc., Littleton, CO (US)

( * ) Notice: Subject to any disclaimer, the term of this patent is extended or adjusted under 35 U.S.C. 154(b) by 242 days.

(21) Appl. No.: 12/785,184

(22) Filed: May 21, 2010

(65) Prior Publication Data

US 2011/0030592 A1 Feb. 10, 2011

Related U.S. Application Data

(63) Continuation-in-part of application No. 10/622,677, filed on Jul. 18, 2003, which is a continuation of application No. 09/893,079, filed on Jun. 26, 2001, now Pat. No. 6,729,248, said application No. 10/622,677 is a continuation of application No. 10/209,083, filed on Jul. 30, 2002, now Pat. No. 7,332,002, and a continuation of application No. 10/209,089, filed on Jul. 30, 2002, now Pat. No. 6,773,471, application No. 12/785,184, which is a continuation-in-part of application No. 11/553,849, filed on Oct. 27, 2006, now Pat. No. 8,124, 036.

(60) Provisional application No. 60/213,915, filed on Jun. 26, 2000, provisional application No. 60/730,971, filed on Oct. 27, 2005.

(51) Int. Cl.
*C10L 5/00* (2006.01)

(52) U.S. Cl.
USPC ..... 44/620; 44/621

(58) Field of Classification Search ..... 44/620, 44/621
See application file for complete search history.

(56) References Cited

U.S. PATENT DOCUMENTS

| | | | |
|---|---|---|---|
| 1,955,574 | A | 4/1934 | Benner et al. |
| 2,844,112 | A | 7/1958 | Muller et al. |
| 3,004,836 | A | 10/1961 | Thompson et al. |
| 3,332,755 | A | 7/1967 | Kukin |
| 3,823,676 | A | 7/1974 | Cook et al. |

(Continued)

FOREIGN PATENT DOCUMENTS

| | | | |
|---|---|---|---|
| CN | 1052838 | | 7/1991 |
| EP | 0060354 | * | 8/1982 |

(Continued)

OTHER PUBLICATIONS

"ADA-ES Tests New Boiler Product," Coal Daily, Apr. 18, 2000, 1 page.

(Continued)

*Primary Examiner* — Cephia D Toomer
(74) *Attorney, Agent, or Firm* — Sheridan Ross P.C.

(57) ABSTRACT

The present invention is directed to an additive, primarily for low sulfur and high alkali coals, that includes a transition metal and optionally a halogen to effect mercury oxidation.

41 Claims, 7 Drawing Sheets

U.S. PATENT DOCUMENTS

| | | | | |
|---|---|---|---|---|
| 3,896,746 | A | | 7/1975 | Pirsh |
| 3,947,354 | A | | 3/1976 | Swanson et al. |
| 3,970,434 | A | | 7/1976 | Gasior et al. |
| 4,051,316 | A | | 9/1977 | Wing et al. |
| 4,057,398 | A | | 11/1977 | Bennett et al. |
| 4,083,783 | A | | 4/1978 | Wing et al. |
| 4,089,507 | A | | 5/1978 | Arai et al. |
| 4,173,454 | A | | 11/1979 | Heins |
| 4,230,460 | A | | 10/1980 | Maust, Jr. |
| 4,238,329 | A | | 12/1980 | Zievers |
| 4,364,818 | A | | 12/1982 | Schmid et al. |
| 4,372,227 | A | | 2/1983 | Mahoney et al. |
| 4,377,118 | A | | 3/1983 | Sadowski |
| 4,385,891 | A | | 5/1983 | Ligotti |
| 4,438,709 | A | | 3/1984 | Borio et al. |
| 4,498,402 | A | | 2/1985 | Kober et al. |
| 4,514,256 | A | | 4/1985 | Kober et al. |
| 4,564,374 | A | | 1/1986 | Hofmann |
| 4,572,085 | A | | 2/1986 | Hepworth |
| 4,577,566 | A | | 3/1986 | Merrell |
| 4,586,443 | A | | 5/1986 | Burge et al. |
| 4,598,652 | A | | 7/1986 | Hepworth |
| 4,668,429 | A | | 5/1987 | Najjar |
| 4,671,804 | A | | 6/1987 | Najjar |
| 4,706,579 | A | | 11/1987 | Merrell |
| 4,741,278 | A | | 5/1988 | Franke et al. |
| 4,753,632 | A | | 6/1988 | Hofmann et al. |
| 4,765,258 | A | | 8/1988 | Zauderer |
| 4,784,670 | A | | 11/1988 | Najjar |
| 4,796,548 | A | | 1/1989 | Merrell et al. |
| 4,831,942 | A | | 5/1989 | Morimoto et al. |
| 4,843,980 | A | | 7/1989 | Markham et al. |
| 4,886,521 | A | | 12/1989 | Khan |
| 4,919,826 | A | | 4/1990 | Alzner |
| 5,001,994 | A | | 3/1991 | Morimoto et al. |
| 5,017,135 | A | | 5/1991 | Meyer |
| 5,022,329 | A | | 6/1991 | Rackley et al. |
| 5,046,265 | A | | 9/1991 | Kalb |
| 5,052,312 | A | | 10/1991 | Rackley et al. |
| 5,114,578 | A | | 5/1992 | Sundström |
| 5,192,338 | A | * | 3/1993 | Waugh et al. ..... 44/627 |
| 5,196,648 | A | | 3/1993 | Jones |
| 5,207,164 | A | | 5/1993 | Breen et al. |
| 5,282,430 | A | | 2/1994 | Nehls, Jr. |
| 5,307,743 | A | | 5/1994 | Jones |
| 5,320,051 | A | | 6/1994 | Nehls, Jr. |
| 5,324,336 | A | | 6/1994 | Child |
| 5,333,558 | A | | 8/1994 | Lees, Jr. |
| 5,357,002 | A | | 10/1994 | Lezzi et al. |
| 5,364,421 | A | | 11/1994 | Westby et al. |
| 5,577,910 | A | | 11/1996 | Holland |
| 5,613,851 | A | | 3/1997 | Trawöger et al. |
| 5,658,487 | A | | 8/1997 | Carey et al. |
| 5,679,259 | A | | 10/1997 | Bolser |
| 5,741,397 | A | | 4/1998 | Kraver |
| 5,795,159 | A | | 8/1998 | Ralls et al. |
| 5,797,742 | A | | 8/1998 | Fraker |
| 5,819,672 | A | | 10/1998 | Radway et al. |
| 5,855,649 | A | | 1/1999 | Durham et al. |
| 5,885,076 | A | | 3/1999 | Ralls et al. |
| 5,888,256 | A | | 3/1999 | Morrison |
| 5,893,943 | A | | 4/1999 | Durham et al. |
| 5,894,806 | A | | 4/1999 | Smyrniotis et al. |
| 5,899,678 | A | | 5/1999 | Thomson et al. |
| 5,972,066 | A | | 10/1999 | Lehtinen |
| 6,022,216 | A | | 2/2000 | Cattani |
| 6,083,306 | A | | 7/2000 | Cattani |
| 6,139,751 | A | | 10/2000 | Bogaert et al. |
| 6,165,366 | A | | 12/2000 | Sarangapani |
| 6,206,685 | B1 | | 3/2001 | Zamansky et al. |
| 6,221,001 | B1 | | 4/2001 | Comer et al. |
| 6,258,456 | B1 | | 7/2001 | Meyer |
| 6,267,802 | B1 | | 7/2001 | Baldrey et al. |
| 6,471,506 | B1 | | 10/2002 | Zamansky et al. |
| 6,484,651 | B1 | | 11/2002 | Shepard et al. |
| 6,613,110 | B2 | | 9/2003 | Sanyal |
| 6,729,248 | B2 | | 5/2004 | Johnson et al. |
| 6,773,471 | B2 | | 8/2004 | Johnson et al. |
| 7,332,002 | B2 | | 2/2008 | Johnson et al. |
| 2004/0016377 | A1 | | 1/2004 | Johnson et al. |

FOREIGN PATENT DOCUMENTS

| | | |
|---|---|---|
| EP | 0433674 | 6/1991 |
| FR | 1394847 | 4/1965 |
| JP | 11-94234 | 4/1999 |
| WO | WO 86/04602 | 8/1986 |
| WO | WO 91/09977 | 7/1991 |

OTHER PUBLICATIONS

"Burning PRB Coals ADA Environmental Offers Flyash Solutions," Western Coal Advisory, Summer/Autumn 1999, 1 page.
"Chapter 10: Cyclone Furnaces," *Steam/Its Generation and Use*, Babcock & Wilcox Company, 1972, 38th Edition, pp. 10-1 to 10-8.
"Chapter 15: Fuel-ash Effects on Boiler Design and Operation," *Steam/Its Generation and Use*, Babcock and Wilcox Company, 1972, pp. 15-1 to 15-26.
"Chapter 21: Fuel Ash Effects on Boiler Design and Operation," *Steam/Its Generation and Use*, Babcock & Wilcox Company, 2005, 41st Edition, pp. 21-1 to 21-27.
"Iron- and Steelmaking," date unknown, pp. 646-660.
Aldrich Chemical Catalog, Aldrich Chemical Co., Inc., 1996, pp. 863-866.
Declaration of Richard Schlager; Sep. 18, 2002.
Niessen, *Combustion and Incineration Processes*, 2002, Marcel Dekker, 3rd Edition, p. 25.
Revised Declaration of Richard Schlager, Aug. 19, 2003.
Sage et al., "Relationship of Coal-Ash Viscosity to Chemical Composition," Journal of Engineering for Power, Apr. 1960, pp. 145-155.
Official Action for U.S. Appl. No. 10/622,677, mailed Jan. 29, 2004.
Official Action for U.S. Appl. No. 10/622,677, mailed Oct. 6, 2004.
Official Action for U.S. Appl. No. 10/622,677, mailed Sep. 9, 2005.
Official Action for U.S. Appl. No. 10/622,677, mailed May 1, 2006.
Official Action for U.S. Appl. No. 10/622,677, mailed Dec. 6, 2006.
Official Action for U.S. Appl. No. 10/622,677, mailed Dec. 7, 2007.
Official Action for U.S. Appl. No. 10/622,677, mailed Aug. 15, 2008.
Official Action for U.S. Appl. No. 10/622,677, mailed Jun. 21, 2010.

* cited by examiner

FIG. 1 - Prior Art

ADDITIVES FOR MERCURY OXIDATION IN COAL-FIRED POWER PLANTS

CROSS REFERENCE TO RELATED APPLICATION

The present application is a continuation-in-part of (A) U.S. patent application Ser. No. 10/622,677, filed Jul. 18, 2003, which is continuation of and claims the benefits of each of the following: (1) U.S. patent application Ser. No. 09/893,079, filed Jun. 26, 2001; (2) U.S. Divisional application Ser. No. 10/209,083, filed Jul. 30, 2002; and (3) U.S. Divisional application Ser. No. 10/209,089, filed Jul. 30, 2002, all of which directly or indirectly claim the benefits, under 35 U.S.C. §119(e), of U.S. Provisional Application Ser. No. 60/213,915, filed Jun. 26, 2000, and (B) of U.S. Ser. No. 11/553,849, filed Oct. 27, 2006, which claims the benefits, under 35 U.S.C. §119(e), of U.S. Provisional Application Ser. No. 60/730,971, filed Oct. 27, 2005, having the same title, each and all of which are incorporated herein fully by this reference.

FIELD

The invention relates generally to additives for coal-fired power plants and particularly to additives for mercury removal.

BACKGROUND

Mercury is a highly toxic element, and globally its discharge into the environment is coming under increasingly strict controls. This is particularly true for power plants and waste incineration facilities. Almost all coal contains small amounts of speciated and elemental mercury along with transition metals (primarily iron) and halogens (primarily chlorine with small amounts of bromine).

Mercury in coal is vaporized in the combustion zone and exits the high temperature region of the boiler entirely as $Hg^o$ while the stable forms of halogens are acid gases, namely HCl and HBr. The majority of coal chlorine forms HCl in the flue gas since the formation of elemental or diatomic chlorine is limited due to other dominant flue gas species including water vapor, sulfur dioxide ($SO_2$), nitrogen oxides (NOx) and sulfur trioxide ($SO_3$). By way of example, the Griffin reaction holds that sulfur dioxide, at the boiler temperature range, reacts with elemental or diatomic chlorine to form sulfur trioxide and HCl. Bromine forms both HBr and $Br_2$ at the furnace exit but at temperatures that are important for mercury oxidation, below about 400° C. it is predominantly present in flue gas as $Br_2$. Elemental mercury oxidation occurs primarily via direct halogenation to mercuric chloride and bromide species by both homogeneous gas-phase and heterogeneous surface/gas reactions. For low rank coals with low to medium sulfur and low chlorine and bromine contents, homogeneous gas-phase Hg oxidation reactions are believed to be limited primarily by diatomic $Cl_2$ and $Br_2$ rather than by HCl and HBr due to the slow reaction rate of HCl and HBr. Therefore, though homogeneous gas phase mercury oxidation by diatomic chlorine does occur as the flue gas cools it is not the dominant reaction pathway because insufficient diatomic chlorine is generally present. Rather, heterogeneous reactions controlled by HCl in the cooler regions of the flue gas path past the economizer section and especially occurring within and downstream of the air preheater, on fly ash particles and on duct surfaces are considered to be the primary reaction pathway for oxidation of elemental mercury by chlorine. At cooler flue gas temperatures elemental or diatomic halogens may be formed from HCl and HBr by, for example, a Deacon process reaction. HCl and HBr react with molecular oxygen at cooler flue gas temperatures to form water and diatomic chlorine and bromine, respectively. This reaction is thermodynamically favorable but proceeds only in the presence of metal catalysts that are primarily present on the surface of entrained fly ash particles or on duct surfaces.

The U.S. Geological Survey database COALQUAL gives halogen data from analyzed coal specimens. According to this data, U.S. coals have bromine contents between 0 and 160 ppm and the mean and median bromine concentration of the coals are 19 and 12 ppm, respectively, and chlorine contents between 0 and 4,300 ppm and the mean and median chlorine concentration of the coals are 569 and 260 ppm, respectively. Based on the data, lignite and sub-bituminous (e.g., Powder River Basin ("PRB")) coals are significantly deficient in halogens as compared to average U.S. coals while bituminous coals are higher in halogens than the lower rank coals. For lower rank coals, $Hg^o$ is the predominant vapor mercury species.

Various methods of augmenting HCl to increase oxidized mercury have been tested at full-scale. Direct addition of halide salts to the coal or injection of halide salts into the boiler has been attempted. There have also been a number of trials of coal blending of low-rank subbituminous coals with higher chlorine bituminous coals. Increased chlorine in the boiler in the form of halide salts or higher chlorine results in an increase of primarily HCl in the flue gas and very limited $Cl_2$. These tests appear to indicate that excess HCl alone does not significantly increase the $HgCl_2$ fraction unless a mechanism exists to make Cl available. Naturally occurring mechanisms that appear to be effective include catalysts in the form of activated carbon or LOI carbon.

For lower rank coals, there is thus a need for an effective mercury control methodology.

SUMMARY

These and other needs are addressed by the various embodiments and configurations of the present invention. The present invention is directed to an additive that includes an additive metal, preferably a transition metal, and optionally one or more halogens or halogenated compounds.

In one embodiment, a composition is provided that includes:

(a) a low sulfur and high alkali coal, the coal feed comprises less than about 1.5 wt. % sulfur (dry basis of the coal) and at least about 20 wt. % (dry basis of the ash) alkali; and (b) an additive comprising:

i) ferrous iron, and ii) ferric iron, wherein a ratio of ferric and higher valence iron to ferrous and lower valence iron in the additive is less than about 2:1; and iii) a halogen-containing compound other than a chlorine compound, the additive comprising at least about 0.005 wt. % (dry basis of the additive) of the halogen-containing compound.

In another embodiment, a composition is provided that includes:

(a) a low sulfur and high alkali coal, the coal feed comprises less than about 1.5 wt. % sulfur (dry basis of the coal) and at least about 20 wt. % (dry basis of the ash) alkali; and (b) an additive comprising:

i) at least about 50 wt. % (dry basis of the additive) ferric and ferrous iron, ii) no more than about 0.5 wt. % (dry basis sulfur of the additive); and iv) at least about 0.1 wt. % (dry basis of the additive) halogen-containing compound other than a chlorine compound.

In yet another embodiment, a method is provided that includes the steps:

(a) providing a coal feed, the coal feed comprising sulfur, alkali, and iron, wherein the sulfur content of the coal feed is no more than about 1.5 wt. % (dry basis of the coal) and the alkali content of the coal feed is at least about 20 wt. % (dry basis of the ash);

(b) combusting the coal feed, in the presence of an added halogen-containing compound, to form a slag;

(c) contacting the coal feed, prior to combustion, with a free-flowing additive, the free-flowing additive comprising at least about 50 wt. % (dry basis additive) iron; and (d) collecting the slag, wherein the slag comprises from about 20 to about 35 wt. % (dry basis slag) silica oxides, from about 13 to about 20 wt. % (dry basis slag) aluminum oxides, and from about 18 to about 35 wt. % (dry basis slag) calcium oxides.

In yet another embodiment, a method is provided that includes the steps:

(a) providing a coal feed, the coal feed comprising sulfur, alkali, and iron; and (b) combusting the coal feed, in a furnace, in the presence of an added halogen-containing compound, and at a combustion temperature ranging from about 2,600 to about 3,000° F., to form a flue gas comprising ash.

The presence of certain additive metals, such as alkali metals, alkaline earth metals, and transition metals, with transition metals being preferred and iron and copper being more preferred, has been found to provide more effective oxidation of elemental mercury. While not wishing to be bound by any theory, it is believed that certain metals, particularly transition metals, catalytically enhance elemental mercury oxidation by halogens. The precise catalytic mechanism is uncertain, but may be due to catalytic promotion of Deacon halogen reaction(s) and an increase of diatomic chlorine and bromine.

Notwithstanding the foregoing, it is also possible that the additive metal is acting as a reactant rather than as a catalytic agent. Regardless of the precise mechanism, certain metals, particularly transition metals, have been observed to increase dramatically the ability of even small amounts of halogens in high sulfur coals to oxidize elemental mercury in the waste gas.

In coal combustion in particular, the additive of the present invention is believed to promote mercury oxidation and sorption by enrichment of transition metal catalysts in the fly ash or on suitable mercury sorbents that are injected and captured with the fly ash. The mechanism may involve a catalytic release of $Cl_2$ from vapor HCl via a Deacon reaction although the specific reactions and intermediates are not well characterized. Enriching the fly ash surface or a supplemental sorbent such as activated carbon with catalysts may mobilize native halogens. However, the halogen availability may still be an overall rate limiting factor. Supplemental halogens addition either with the coal feed or downstream in the mercury oxidation region may be required.

When iron is used as the metal in the additive, other significant benefits can be realized.

For example, the ability of wet bottom boilers, such as cyclone boilers, to burn low iron, low sulfur, and high alkali western coals has been found to be enhanced substantially by iron addition. A "high alkali" coal typically includes at least about 20 wt. % (dry basis of the ash) alkali (e.g., calcium). As will be appreciated, western coals, particularly from the Powder River Basin, are low sulfur and high alkali coals. While not wishing to be bound by any theory, iron, in the calcium aluminosilicate slags of western coals, is believed to act as a fluxing agent and cause a decrease in the melting temperature of the ash and crystal formation in the melt when a critical temperature ($T_{CV}$) is reached. These crystals change the flow characteristics of the slag causing the slag to thicken before the slag can flow. This phenomenon is known as "yield stress" and is familiar to those skilled in the art of non-Newtonian flow. Thicker slag allows the slag to capture and hold more coal particles. Therefore, fewer coal particles escape the combustor without being burned.

In one embodiment, the additive is in the form of a free-flowing particulate having a $P_{90}$ size of no more than about 300 microns (0.01 inch) and includes at least about 50 wt. % iron, no more than about 1 wt. % carbon, no more than about 0.1 wt. % sulfur, and at least about 0.5 wt. % halogens. Compared to iron pellets, the relatively small particle size of the additive reduces significantly the likelihood of the formation of pools of reduced iron that can be very corrosive to metal or refractory surfaces exposed to the iron. It is believed that the reason for pooling and poor fluxing has been the relatively large sizes of iron pellets (typically the $P_{90}$ size of the pellets is at least about 0.25 inch (6350 microns)) in view of the short residence times of the pellets in the combustion chamber. Such pellets take longer to heat and therefore melt and act as a flux. This can cause the pellets to pass or tumble through the chamber before melting has fully occurred. The increase surface area of the additive further aids in more effective fluxing as more additive reaction surface is provided.

The iron can be present in any form(s) that fluxes under the conditions of the furnace, including in the forms of ferrous or ferric oxides and sulfides. In one formulation, iron is present in the form of both ferric and ferrous iron, with ferric and ferrous iron oxides being preferred. Preferably, the ratio of ferric (or higher valence) iron to ferrous (or lower valence) iron is less than 2:1 and more preferably ranges from about 0.1:1 to about 1.95:1, or more preferably at least about 33.5% of the iron in the additive is in the form of ferrous (or lower valence) iron and no more than about 66.5% of the iron in the additive is in the form of ferric (or higher valence) iron. In a particularly preferred formulation, at least about 10% of the iron in the additive is in the form of wustite. "Wustite" refers to the oxide of iron of low valence which exist over a wide range of compositions (e.g., that may include the stoichiometric composition FeO) as compared to "magnetite" which refers to the oxide of iron of intermediate or high valence which has a stoichiometric composition of $Fe_2O_3$ (or $FeO.Fe_2O_3$). It has been discovered that the additive is particularly effective when wustite is present in the additive. While not wishing to be bound by any theory, it is believed that the presence of iron of low valence levels (e.g., having a valence of 2 or less) in oxide form may be the reason for the surprising and unexpected effectiveness of this additive composition.

The additive can include a mineralizer, such as zinc oxide. While not wishing to be bound by any theory, it is believed that the zinc increases the rate at which iron fluxes with the coal ash. Zinc is believed to act as a mineralizer. Mineralizers are substances that reduce the temperature at which a material sinters by forming solid solutions. This is especially important where, as here, the coal/ash residence time in the combustor is extremely short (typically less than about one second and even more typically less than about 500 milliseconds). Preferably, the additive includes at least about 1 wt. % (dry basis) mineralizer and more preferably, the additive includes from about 3 to about 5 wt. % (dry basis) mineralizer. Mineralizers other than zinc oxides include calcium, halogen-containing compounds such as magnesium or manganese fluorides or sulfites and other compounds known to those in the art of cement-making. Preferably, the additive includes no more than about 0.5 wt. % (dry basis) sulfur, more preferably includes no more than about 0.1 wt. % (dry basis) sulfur, and even more preferably is at least substantially free of sulfur.

The additive can be contacted with the flue gas by any suitable mechanism. For example, the additive components can be added separately (at different times) or collectively (e.g., simultaneously) to the coal feed. When the coal feed is combusted, the halogen enters the vapor phase. Alternatively, the iron component can be added to the coal feed while the halogen is injected into the flue gas in or downstream of the furnace.

The present invention can provide further advantages depending on the particular configuration. By way of example, the additive(s), as noted, can provide a slag layer in the furnace having the desired viscosity and thickness at a lower operation temperature. As a result, there is more bottom ash to sell, more effective combustion of the coal, more reliable slag tapping, improved boiler heat transfer, and a relatively low amount of entrained particulates in the offgas from combustion, leading to little or no degradation in performance of particulate collectors (due to the increased particulate load). The boiler can operate at lower power loads (e.g., 60 MW without the additive and only 35 MW with the additive as set forth below) without freezing the slag tap and risking boiler shutdown. The operation of the boiler at a lower load (and more efficient units can operate at higher load) when the price of electricity is below the marginal cost of generating electricity, can save on fuel costs. The additive can reduce the amount of coal burned in the main furnace, lower furnace exit temperatures (or steam temperatures), and decrease the incidence of convective pass fouling compared to existing systems. The additive can have little, if any, sulfur, thereby not adversely impacting sulfur dioxide emissions. These and other advantages will become evident from the following discussion.

These and other advantages will be apparent from the disclosure of the invention(s) contained herein.

The above-described embodiments and configurations are neither complete nor exhaustive. As will be appreciated, other embodiments of the invention are possible utilizing, alone or in combination, one or more of the features set forth above or described in detail below.

As used herein, "ash" refers to the residue remaining after complete combustion of the coal particles. Ash typically includes mineral matter (silica, alumina, iron oxide, etc.).

As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

As used herein, "high alkali coals" refer to coals having a total alkali (e.g., calcium) content of at least about 20 wt. % (dry basis of the ash), typically as CaO, while "low alkali coals" refer to coals having a total alkali content of less than 20 wt. % and more typically less than about 15 wt. % alkali (dry basis of the ash), typically as CaO.

As used herein, "coal" refers to macromolecular network comprised of groups of polynuclear aromatic rings, to which are attached subordinate rings connected by oxygen, sulfur and aliphatic bridges. Coal comes in various grades including peat, lignite, sub-bituminous coal and bituminous coal. In one process configuration, the coal includes less than about 1.5 wt. % (dry basis of the coal) sulfur while the coal ash contains less than about 10 wt. % (dry basis of the ash) iron as $Fe_2O_3$, and at least about 15 wt. % calcium as CaO (dry basis of the ash). The material is preferably in the form of a free flowing particulate having a $P_{90}$ size of no more than about 0.25 inch.

As used herein, "halogen" refers to an electronegative element of group VIIA of the periodic table (e.g., fluorine, chlorine, bromine, iodine, astatine, listed in order of their activity with fluorine being the most active of all chemical elements).

As used herein, "halide" refers to a binary compound of the halogens.

As used herein, "high sulfur coals" refer to coals having a total sulfur content of at least about 1.5 wt. % (dry basis of the coal) while "low sulfur coals" refer to coals having a total sulfur content of less than about 1.5 wt. % (dry basis of the coal).

As used herein, "high iron coals" refer to coals having a total iron content of at least about 10 wt. % (dry basis of the ash), typically as $Fe_2O_3$, while "low iron coals" refer to coals having a total iron content of less than about 10 wt. % (dry basis of the ash), typically as $Fe_2O_3$. As will be appreciated, iron and sulfur are typically present in coal in the form of ferrous or ferric carbonates and/or sulfides, such as iron pyrite.

As used herein, "transition metal" or "transition element" refers to any of a number of elements in which the filling of the outermost shell to eight electrons within a period is interrupted to bring the penultimate shell from 8 to 18 or 32 electrons. Only these elements can use penultimate shell orbitals as well as outermost shell orbitals in bonding. All other elements, called "major group" elements, can use only outermost-shell orbitals in bonding. Transition elements include elements 21 through 29 (scandium through copper), 39 through 47 (yttrium through silver), 57 through 79 (lanthanum through gold), and all known elements from 89 (actinium) on. All are metals.

DETAILED DESCRIPTION

The Additive

Figure 1:
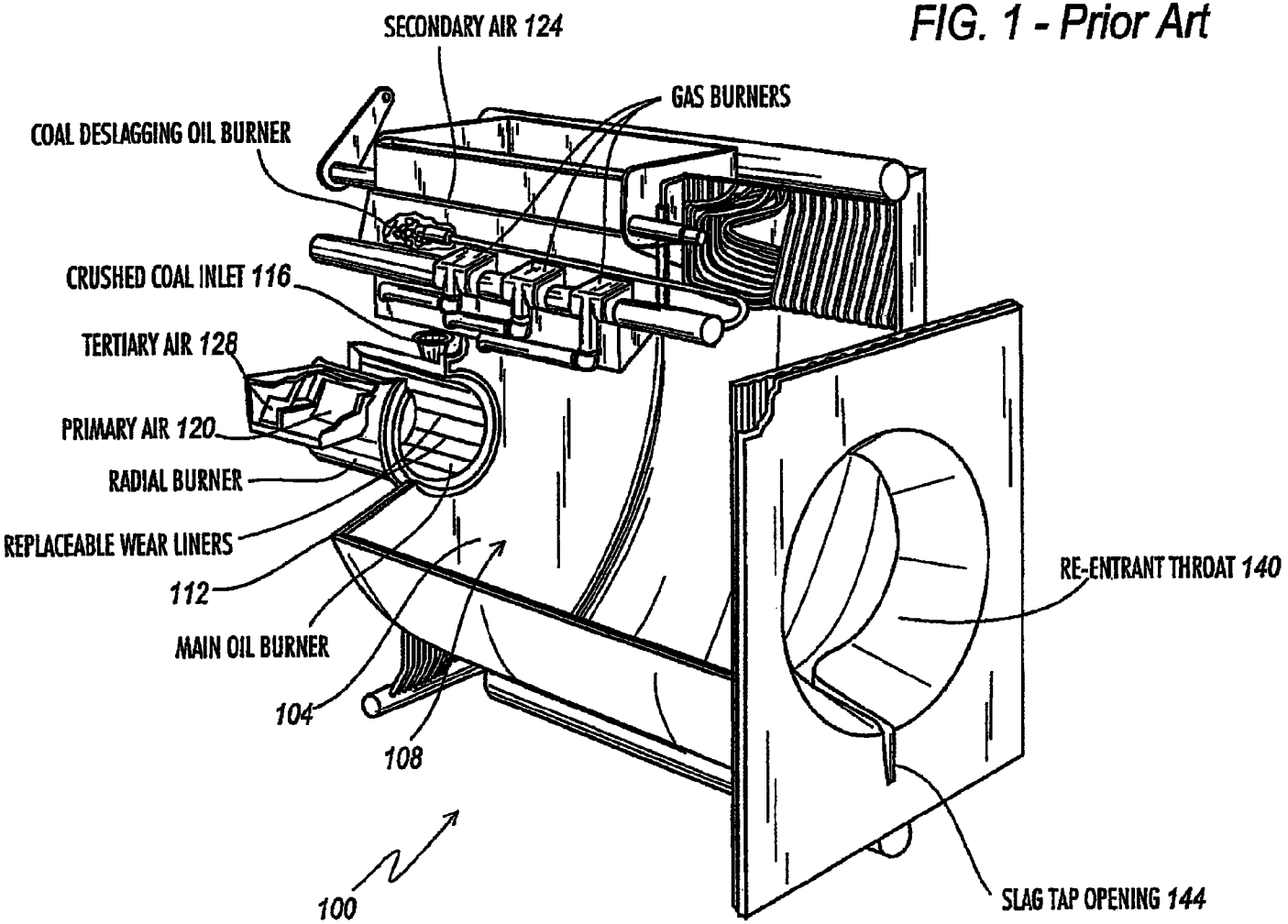
FIG. 1 is a prior art depiction of a cyclone boiler.
Figure 2:
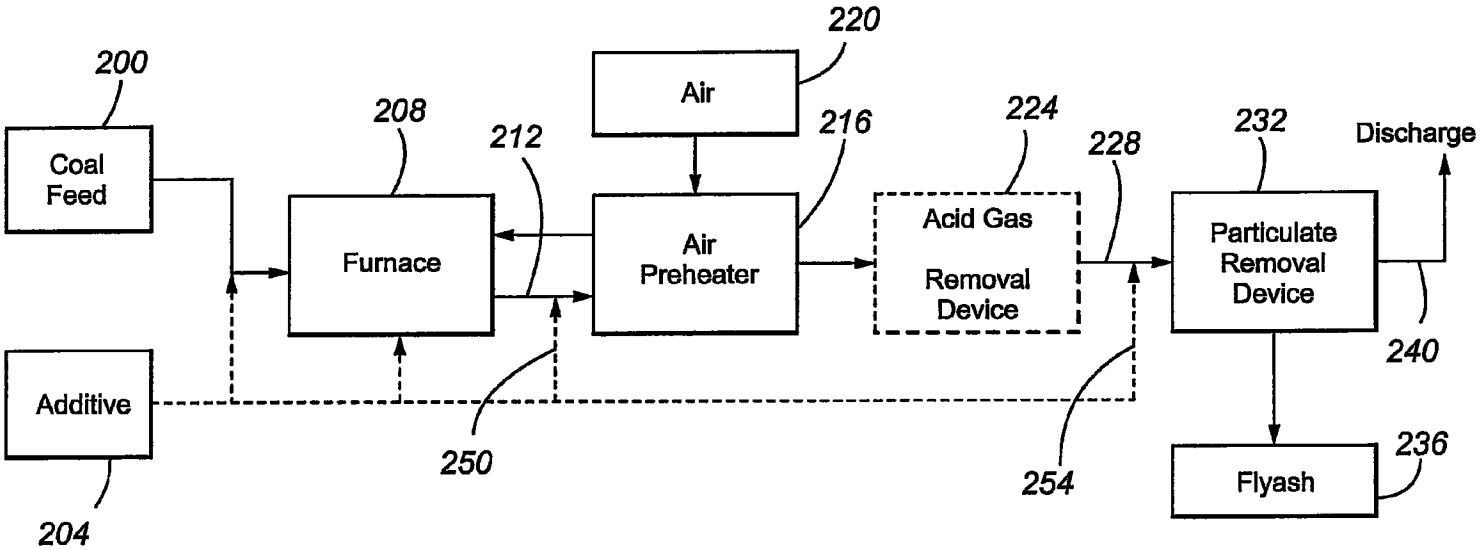
FIG. 2 is a block diagram of a coal combustion waste gas treatment assembly according to an embodiment.

The additive of the present invention is believed to promote elemental mercury oxidation by means of metal mercury oxidation catalysts. The catalysis mechanism may involve formation of diatomic chlorine or bromine via the Deacon process reaction or a similar reaction occurring at the fly ash surface in the presence of vapor HCl and/or HBr. The direct addition of reactive metal compounds where there is sufficient vapor halogen can achieve high levels of mercury oxidation and mercury capture. If needed, halogens and halide compounds can be added, as part of or separate from the additive, to promote mercury oxidation in proximity to surface sites of collected fly ash in particulate control devices where natively occurring flue gas halide or halogen concentration(s) alone are insufficient to promote such oxidation.

While the additive metal is described as likely acting as a catalyst, rather than a reactant, in the oxidation of mercury, it is to be understood that the metal may be performing a non-catalytic function. Evidence can also support the metal undergoing a heterogeneous reaction or a gas/gas and gas/solid reaction with the elemental mercury. The phrase "additive metal" is therefore not to be limited to a catalytic function but may also or alternatively be read to include one or more other types of reactions.

In a first formulation, the additive includes one or more additive metals, in either elemental, diatomic, or speciated form, or a precursor thereof, to catalyze oxidation of elemental mercury by natively occurring halogens and/or interhalogen compounds. The additive metals are preferably one or more transition metals, with iron, vanadium, manganese, and copper being preferred, iron and copper being more preferred, and iron being particularly preferred. Particularly preferred forms of iron and copper are oxides, transition metal halide salts (e.g., inter transition/halogen compounds), transition metal sulfides, transition metal sulfates, and transition metal nitrates, in which the transition metal has a higher oxidation state, with a "higher" oxidation state being at least a charge of +2 and more preferably at least a charge of +3 with the highest desirable oxidation state being +4. Exemplary transition metal catalysts include metal oxides (e.g., $V_2O_3$, $V_2O_4$, $V_2O_5$ FeO, $Fe_2O_3$, $Fe_3O_4$, copper (I) oxide ($Cu_2O$), and copper (II) oxide (CuO)), metal halides (e.g., iron (III) chloride, iron (II) chloride ($FeCl_2$), iron (II) bromide, iron (III) bromide, and copper (II) chloride), metal nitrates (e.g., copper nitrates including copper (II) nitrate (Cu $(NO_3)_2$, and iron (III) nitrate (Fe $(NO_3)_3$)), metal sulfates (e.g., iron (III) sulfate ($Fe_2(SO_4)_3$), iron (II) sulfate ($FeSO_4$), manganese dioxide ($MnO_2$), and higher forms and hydrated states of the foregoing transition metals. The additive may have the additive metal in a lower oxidation state provided that, after introduction into the combustion zone or flue gas, the additive metal is oxidized to a higher oxidation state.

In one configuration, the additive is manufactured by any one of a number of processes. For example, the additive can be iron-enriched recycle products from steel mills, such as the particles removed by particulate collection systems (e.g., by electrostatic precipitators or baghouses) from offgases of steel or iron manufacturing, oily mill scale fines, enriched iron ore materials, such as taconite pellets or magnetite, red mud from the bauxite mining industry, recycled fly ashes or other combustion byproducts enriched in additive metals such as high-iron fly ashes, cement kiln dusts or combustion ashes from oil-fired boilers that have high concentrations of vanadium, and finely divided powders made from these materials by milling or grinding. Preferably, the additive is the collected fines (flue dust and/or electrostatic precipitator dust) from the offgas(es) of a blast furnace, Basic Oxygen Furnace (BOF), or electric arc furnace, dust such as used in the iron or steel making industry. In such materials, the iron and mineralizer are typically present as oxides.

The additive metal in these additives are predominantly iron oxides. Preferably, the additive includes at least about 50 wt. % (dry basis) iron and more preferably at least about 70 wt. % (dry basis) iron and even more preferably from about 70 to about 90 wt. % (dry basis) iron. Preferably, the ratio of ferric (or higher valence) iron to ferrous (or lower valence) iron is less than 2:1 and even more preferably ranges from about 0.1:1 to about 1.9:1, or more preferably at least about 33.5% and even more preferably at least about 35% and even more preferably at least about 40% of the iron in the additive is in the form of ferrous (or lower valence) iron and no more than about 65% of the iron in the additive is in the form of ferric (or higher valence) iron. In a particularly preferred formulation, at least about 10%, more preferably at least about 15% of the iron is in the form of wustite, and even more preferably from about 15 to about 50% of the iron is in the form of wustite.

The additive in this configuration can include other beneficial materials.

One beneficial material is a mineralizing agent, such as zinc. While not wishing to be bound by any theory, it is believed that the zinc increases the rate at which iron fluxes with the coal ash in slag-type furnaces. "Ash" refers to the residue remaining after complete combustion of the coal particles and typically includes mineral matter (silica, alumina, iron oxide, etc.). Mineralizers are substances that reduce the temperature at which a material sinters by forming solid solutions. This is especially important because the coal/ash residence time in the combustor is typically extremely short (typically less than about one second and even more typically less than about 500 milliseconds). Preferably, the additive includes at least about 0.1 wt. % (dry basis) mineralizer, more preferably at least about 1 wt. % (dry basis) mineralizer, even more preferably from about 3 to about 15 wt. % (dry basis) mineralizer, even more preferably from about 2 to about 8 wt. % (dry basis), and even more preferably from about 3 to about 5 wt. % (dry basis) mineralizing agent. After combination with the coal feed, the coal feed typically includes iron in an amount of at least about 0.5 wt. % (dry basis) and the mineralizer in an amount of at least bout 0.005 wt. % (dry basis). Mineralizers other than zinc oxides include halides, such as calcium, magnesium or manganese iodides, bromides, and fluorides, or calcium, magnesium, or manganese sulfites and other compounds known to those in the art of cement-making. Preferably, the mineralizer is free of chlorine. Due to the formation of sulfur oxides, the additive preferably includes no more than about 0.5 wt. % (dry basis) sulfur, more preferably includes no more than about 0.1 wt. % (dry basis) sulfur, and even more preferably is at least substantially free of sulfur.

Other beneficial materials include oils and greases produced during metal finishing operations. Oils and greases have the advantages of preventing fugitive emissions during handling and shipping and replacing the heat input requirement from the coal in the boiler and thus reduce fuel costs for producing electricity. Typically, such additives will contain from about 0.1 to about 10 wt. % (dry basis) greases and oils.

In coal-fired flue gases from low rank subbituminous coals, oxidation of vapor phase elemental mercury to the primary ionic species mercury chloride ($HgCl_2$) and bromine chloride ($HgBr_2$) is believed to depend primarily upon the presence of sufficient hydrogen chloride (HCl) and other halogens in the flue gas. While not wishing to be bound by any theory, mercury oxidation reaction mechanisms are postulated to be various homogeneous gas phase reactions and complex multistep heterogeneous reactions involving gas/solid surface exchange reactions. Oxidation is limited by available halogens in the flue gas for the case of subbituminous coal combustion. It is believed that the oxidation and chemisorption of the mercury onto activated carbon sorbents or onto native unburned carbon in the fly ash involves multi-step heterogeneous chemical reactions at surface sites. These reactions may be catalyzed by certain metals and metal oxides present on the carbon. The additive of the present invention enhances unburned carbon sorption of mercury by enrichment of the fly ash with additive metals in combination with sufficient oxidizing agents at the carbon surface.

If diatomic chlorine and bromine were to become available at the downstream fly ash surfaces, for example via catalyzed reaction of HCl with active metal surface sites on carbon enriched fly ash, then it can readily recombine with elemental mercury to form mercury chloride species, primarily $HgCl_2$. By way of example, vanadium pentoxide $V_2O_5$, CuO, and $Fe_2O_3$ are examples of transition metal mercury oxidation catalysts typically present in fly ash. The temperature at the fly ash surface governs the reaction rate. In the relatively cool zone of particulate control devices, $Hg^o$ reacts rapidly with any available diatomic chlorine to form $HgCl_2$. This oxidized mercury can then bind to surface sites within the fly ash or to activated carbon or LOI carbon within the fly ash layer.

In a second formulation, the additive includes one or more additive metal catalysts or a precursor thereof and one or more diatomic halogens (e.g., $Cl_2$ and $Br_2$), interhalogen compounds (e.g., BrCl), and halide salts to act as elemental mercury oxidants. Preferred supplemental halide salts are calcium chloride ($CaCl_2$), iron (III) chloride ($FeCl_3$), copper (II) chloride ($CuCl_2$), magnesium bromide ($MgBr_2$), calcium bromide, sodium bromide, potassium iodide, and also the hydrated states of these halide salts. The halogens may also be introduced in other organically and inorganically bound forms. Interhalogen compounds, such as BrCl, are believed to behave as diatomic halogens with respect to elemental mercury oxidation. They are also believed to survive combustion and to be substantially nonreactive with sulfur oxides. The second formulation is used where the coal has a low halogen content, as is the case for lower rank coals, such as lignite and sub-bituminous coals. Such coals are typically deficient in bromine and chlorine relative to the mercury content of the coal.

In a third formulation, the additive is in the form of a carrier substrate carrying the metal additive metal and/or halogen. The carrier substrate is preferably a high surface area sorbent with suitable surface functional groups for mercury sorption. In a particularly preferred formulation, the mercury oxidation catalyst is directly deposited onto a mercury sorbent. Preferred carrier substrates include activated carbon, ash, and zeolites. The activated carbon can be manufactured from any source, such as wood charcoal, coal, coke, coconut shells, resins, and the like. The additive metal and/or halogen are deposited on the carrier substrate by known techniques, such as by chemical precipitation, ionic substitution, or vapor deposition techniques. By way of example, impregnation method can be by liquid contact (rinse) of the sorbent with aqueous solution of any of the soluble mercury oxidation catalysts or, more preferably, by mechanical dry grinding of the sorbent with any of the powdered or granular mercury oxidation catalysts. In a particularly preferred formulation, the mercury sorbent is activated carbon and the mercury oxidation catalyst for sorbent contact is Copper (II) chloride. Oxidation and capture of the oxidized mercury are then accomplished at the surface of the injected sorbent, generally powdered activated carbon. The catalyst-impregnated sorbent is preferably injected as a dry powder into the flue gas upstream of the particulate control device. The sorbent is co-precipitated with fly ash in an ESP or co-deposited onto the ash filter cake in a baghouse.

In a fourth formulation, the additive is in the form of a combustible carbonaceous substrate, preferably coal or fly ash, on which the additive metal and/or halide is deposited. The deposition is by any suitable technique, including those referenced in connection with the third formulation. Unlike the third formulation, the additive metal and halide is intimately bound with the combustible carbon. As a result, the additive metal and halide will be released into the flue gas when the substrate is combusted. This will lead to a high degree of dispersion of the metal and halide in the flue gas. This will, in turn, potentially provide a higher degree of and more rapid oxidation of mercury.

In any of the above formulation, the amounts of the additive metal and halogen in the additive depend on the natively occurring amounts of mercury, additive metal, and halogen in the coal. Preferably, the additive of the first formulation contains from about 10 to about 100 wt. % additive metal, more preferably from about 25 to about 100 wt. % additive metal, and even more preferably from about 50 to about 100 wt. % additive metal. The additive is preferably free or substantially free of halogens. In the second formulation, the additive contains preferably from about 10 to about 90 wt. % additive metal, more preferably from about 25 to about 90 wt. % additive metal, and even more preferably from about 50 to about 90 wt. % additive metal and from about 0.1 to about 50 wt. % halogen, more preferably from about 0.5 to about 10 wt. % halogen, and even more preferably from about 0.5 to about 5.0 wt. % halogen. The third and fourth formulations preferably include from about 1 to about 99 wt. % substrate; from about 0.1 to about 50 wt. % additive metal, more preferably from about 0.1 to about 35 wt. % additive metal, and even more preferably from about 0.1 to about 20 wt. % additive metal; and from about 0 to about 30 wt. % halogen, more preferably from about 0 to about 20 wt. % halogen, and even more preferably from about 0 to about 10 wt. % halogen.

Regardless of the formulation, the temperature at the fly ash and/or carrier substrate surface governs the reaction rate. In the relatively cool zone of particulate control devices, $Hg^o$ reacts rapidly with any available diatomic chlorine and bromine to form $HgCl_2$ and $HgBr_2$. This oxidized mercury can then bind to surface sites (or LOI carbon) within the entrained, uncollected fly ash, LOI carbon within the collected fly ash layer, or to the mercury sorbent.

The rate of introduction of the additive to the furnace and/or flue gas depends on the combustion conditions and the chemical compositions of the coal feed and additive. Typically, the additives of the first and second formulations are introduced in the form of a dry powder or liquid and in an amount ranging from about 10 to about 50 lb/ton coal and more typically from about 10 to about 20 lb/ton coal. Stated another way, the additive of the first and second formulations are preferably introduced at a concentration of from about 0.3 to about 100 lbs additive/Mmacf in the flue gas or in an amount ranging from about 0.1 to about 3.0% by weight of the coal feed 200, with from about 0.5 to about 1.5% being preferred. The additive metal-impregnated sorbent of the third formulation is preferably introduced as a dry powder into the flue gas upstream of the particulate control device at a concentration of from about 0.1 to about 10.0 lbs sorbent/Mmacf in the flue gas.

The additive is preferably in the form of a free-flowing particulate having a relatively fine particle size. Preferably, the $P_{90}$ size of the additive is no more than about 300 microns, more preferably no more than about 150 microns, and even more preferably no more than about 75 microns.

The Use of the Additive

The use of the additive will now be described with reference to FIG. 1.

The coal feed 200 is predominantly coal, with lower rank coals being preferred. Although any rank coal or composition of coal can be treated effectively by the additive 204 of the present invention, the coal feed 200 has a preferred composition for optimum results. The coal feed 200 preferably has an alkali component that ranges from about 12 to about 25 wt. % (dry basis) of the ash, a sulfur composition ranging from about 0.1 to about 1.5 wt. % (dry basis) of the ash, a phosphorus content ranging from about 0.1 to about 1.5 wt. % (dry basis) of the ash, an iron content ranging from about 2 to about 7 wt. % (dry basis) of the ash, a silica content ranging from about 9 to about 16 wt. % (dry basis) of the ash, and an alumina content ranging from about 13 to about 20 wt. % (dry basis) of the ash. Because oxidized mercury is sorbed onto the fly ash, it is preferred that the fly ash 236 has a Loss On Ignition content of at least about 10 wt. % (dry basis) and more preferably ranging from about 15 to about 50 wt. % (dry basis).

The coal feed 200, particularly when it is a low iron and high alkali coal, such as a PRB coal, can have low halogen content. Typically, such coals comprise no more than about 500 ppm (dry basis of the coal) halogens, more typically no more than about 250 ppm (dry basis of the coal) halogens, and even more typically no more than about 100 ppm (dry basis of the coal) halogens. The halogens are predominantly chlorine with some bromine. The atomic ratio of chlorine to bromine in such coals typically ranges from about 1:1 to about 250:1. Stated another way, such coals typically comprise no more than about 500 ppm (dry basis of the coal) chlorine, more typically no more than about 250 ppm (dry basis of the coal) chlorine, and even more typically no more than about 100 ppm (dry basis of the coal) chlorine and typically comprise no more than about 25 ppm (dry basis of the coal) bromine, and more typically no more than about 15 ppm (dry basis of the coal) bromine, and even more typically no more than about 10 ppm (dry basis of the coal) bromine. The coal feed 200 is preferably in the form of a free flowing particulate having a $P_{90}$ size of no more than about 0.25 inch.

The coal feed 200 is introduced into and combusted in the furnace 208. A properly designed furnace burns the coal feed completely and cools the combustion products sufficiently so that the convection passes of the boiler unit is maintained in a satisfactory condition of cleanliness. Coal-fired furnaces have many different configurations and typically include a plurality of combustors. Preferably, the furnace is a dry-ash, fuel-bed, chain-grate, spreader stoker, or slag-tap unit. In a "slag type" or "Slag tap" furnace configuration, a slag layer forms on a surface of the burner and captures the coal particles for combustion. In a typical furnace, the combustion temperature of the coal, and flue gas temperature, ranges from about 1,425 to about 1,650° C. (2,600 to 3,000° F.). An example of a combustor 100 for a slag-type furnace is depicted in FIG. 1. The depicted combustor design is used in a cyclone furnace of the type manufactured by Babcock and Wilcox. Cyclone furnaces operate by maintaining a sticky or viscous layer of liquid (melted) ash (or slag) (not shown) on the inside cylindrical walls 104 of the cyclone combustion chamber 108. Coal is finely crushed or pulverized (e.g., to minus ¼ inch top size), entrained in an airstream, and blown into the combustor end 112 of the cyclone combustor or combustor 100 through coal inlet 116. Combustion air (shown as primary air 120, secondary air 124, and tertiary air 128) is injected into the combustion chamber 108 to aid in combustion of the coal. The whirling motion of the combustion air (hence the name "cyclone") in the chamber 108 propels the coal forward toward the furnace walls 104 where the coal is trapped and burns in a layer of slag (not shown) coating the walls. The re-entrant throat 140 (which restricts escape of the slag from the chamber 108 via slag tap opening 144) ensures that the coal particles have a sufficient residence time in the chamber 108 for complete combustion. Commonly, the residence time of the slag in the cyclone is on the order of about 20 to about 60 minutes. The slag and other combustion products exit the chamber 108 through the slag tap opening 144 at the opposite end from where the coal was introduced. The molten slag (not shown) removed from the chamber 108 flows to a hole (not shown) in the bottom of the boiler where the slag is water-quenched and recovered as a saleable byproduct.

The ash composition is important to prevent the slag from freezing in the hole and causing pluggage. To melt ash into slag at normal combustion temperatures (e.g., from about 2,600 to about 3,000° F.), slag-type furnaces, such as cyclones, are designed to burn coals whose ash contains high amounts of iron and low amounts of alkali and alkaline earth metals. When burning low iron and sulfur and high alkali coals, such as PRB coals, the additive includes iron as the additive metal. Iron both reduces the melting temperature of the ash and increases the slag viscosity at these temperatures due to the presence of iron aluminosilicate crystals in the melt.

The flue gas 212 from the furnace 208 passes through an economizer section (not shown) and through an air preheater 216. The air preheater 216 is a heat exchange device in which air 220 for the furnace 208 is preheated by the flue gas 212. Immediately upstream of the air preheater 216, the flue gas 212 has a temperature ranging from about 480 to about 880° F. while immediately downstream of the air preheater 216 the flue gas 212 has a temperature ranging from about 260 to about 375° F.

After passing through the air preheater 216, the flue gas is treated by an acid gas removal device 224. An example of an acid gas removal device 224 is a flue gas desulfurizer. The device 224 typically removes most and more typically substantially all of the sulfur oxides in the flue gas.

The acid gas treated flue gas 228 is next passed through a particulate removal device 232, such as a fabric filter baghouse or cold-side electrostatic precipitator, to remove preferably most and more preferably substantially all of the particles, particularly fly ash 236 and sorbent (if any), in the flue gas. Most of the oxidized mercury and excess halogens are absorbed by the fly ash and/or mercury sorbent of the third formulation and is therefore removed by the device 232.

In one plant configuration, the acid gas removal device 224 is positioned downstream of the particulate removal device 232.

The treated flue gas 240 is then discharged through a stack (not shown) into the atmosphere.

The treated flue gas 240 complies with applicable environmental regulations. Preferably, the treated flue gas 240 includes no more than about 0.0002 ppmv mercury (of all forms) (i.e., $<1.0\ \mu g/std.-m^3$).

The additive 200 can be introduced into the combustion system in a number of locations. The additive 200 can be combined and introduced with the coal feed 200, injected into the furnace atmosphere independently of the coal feed 200, injected into the flue gas 212 upstream of the air preheater 216, or injected into the acid gas treated flue gas 228 upstream of the particulate removal device 232.

Selection of mercury oxidation catalyst and the method of delivery depends not only on the configuration but also on the location of additive introduction.

For plants that have inherently high unburned (or LOI) carbon in the fly ash as a result of combustion optimization for $NO_x$ control, including both Pulverized Coal ("PC") boilers and cyclone boilers, mercury control can be readily achieved by utilization of the fly ash without use of the third formulation. Unburned Loss-On-Ignition ("LOI") carbon in the ash has a low Brunauer-Emmet-Teller ("BET") surface area compared to activated carbon. However, the quantity available and the exposed large pore surface sites make it a good sorbent for in-flight mercury capture if the mercury can be absorbed onto the ash. The additive can improve mercury sorption of unburned carbon for these plants by 1) enriching the ash with mercury oxidation catalysts, 2) effecting better utilization of available HCl and HBr and 3) providing supplemental oxidizing agents (halogens), when needed to promote heterogeneous mercury oxidation and chemisorption on the unburned carbon. Enrichment of the unburned carbon and fly ash is effected by addition of the additive either into the coal feed 200 or by injection into the boiler 208. A portion of the metals are incorporated into the fly ash as various forms of oxides.

For plants with minimal unburned carbon (i.e., an LOI carbon content of no more than about 5 wt. %), mercury oxidation can be promoted by injection of the additive into the flue gas downstream of the furnace 208. The additive of the first or second formulation is distributed with alkaline fly ash or fly ash with high-calcium spray dryer solids or the additive of the third formulation is used without supplemental fly ash addition. Selection of oxidation catalysts for downstream injection is not limited to oxide forms.

For non-scrubbing plants firing subbituminous Powder River Basin coals, or for a blend of sub-bituminous and bituminous coals, addition of the additive to the coal feed 200 or direct injection of the additive 200, as a powdered solid or liquid atomized solution containing the additive into the boiler via overfire air (OFA) ports, are preferred options. In the former option, the additive is pre-mixed into the as-received coal, added and mixed on the coal pile, vapor deposited on the coal (discussed below), or added in the coal handling system, preferably prior to crushers and/or pulverizers. Transition metals intimately mixed with the coal will form transition metal oxides in the combustion zone and ultimately a fraction of these will report to the fly ash 236.

When the additive is injected into the furnace, the injection point and method will depend upon the boiler configuration. Overfire air ports (OFA) are a preferred location, where available. The additive can be either blown in as a finely divided powder or injected as a finely atomized liquid solution through OFA ports.

For either additive introduction with the coal feed or injection into the boiler 208, the resulting halide or halogen concentration in the flue gas after injection of the mercury oxidation catalyst is preferably less than about 120 ppm. Higher HCl concentrations are undesirable due to concerns with excessive corrosion of internal boiler tube and downstream duct structures. Additive composition can be tailored to the particular fuel fired and may include a combination of a supplemental halide salt and a transition metal containing material in different mix proportions. If sufficient native chloride and bromide are available in the coal then a preferred additive for fuel or boiler addition is the first formulation.

When sufficient halogens are not present, limited amounts of halide salts may be added with the additive as set forth above in the second formulation. The halide salts may be pre-mixed into the bulk additive to provide freeze conditioning or dust control or to improve handling characteristics of the material. The supplemental halide salts will decompose at combustion forming primarily HCl or HBr or HI and then further forming some fraction of diatomic chlorine, bromine or iodine in the cooling flue gases.

The additive of the second formulation is particularly useful for effective mercury removal for coals having relatively low concentrations of native halogens and/or where minimal levels of additional halides are required to convert the primarily elemental mercury) (Hg°) to oxidized mercury species, e.g., $HgCl_2$. In the second formulation, it is desirable to maintain the concentration of HCl to a level less than that creating undesirable fouling or corrosion. This level is preferably no more than about 200 ppm total HCl in the flue gas. While not wishing to be bound by any theory, it is believed that catalyzed mercury oxidation takes place primarily in intimate contact with the ash surface in the particulate collection device 232. Chemisorption of the oxidized mercury onto a suitable particulate substrate selected from a calcium-enriched fly ash, residual unburned carbon (LOI carbon) in fly ash, or supplemental sorbents, such as powdered activated carbon, is accomplished in the fly ash baghouse filter cake or the electrostatic precipitator collected ash layer.

One disadvantage to the direct addition of bromine and iodine compounds is the potential for atmospheric emission of bromine or iodine or hazardous organic halogenated compounds. If discharged to the atmosphere, the amount of bromine or iodine liberated and available for upper level atmospheric ozone destruction is equivalent to firing a higher halogen coal. Nevertheless, the net benefit of mercury control is diminished if a low level but high volume continuous bromine emission were to be allowed. This present invention can reduce the potential for bromine slip in two ways:

II. For the case of upstream addition of halogenated compounds in combination with transition metal catalysts, excess of unburned carbon and formation of catalyst-enriched carbon ash essentially sorb and bind all of the halogen oxidizing agents to the ash.

III. For the case of downstream addition of activated carbon impregnated with transition metal halide salts, the halide is bound to the carbon and there will be no significant evolution of free molecular or atomic halogen species even though the relative quantity of carbon is less than for the case of unburned carbon enhancement.

Yet another additive introduction location is injection into the flue gas upstream of the particulate control device 232. The precise location of the injection point will depend upon the plant duct configuration and Air Pollution Control ("APC") type. Location 250 represents addition of the additive past the economizer section and upstream of the unit air preheater 216. In this region, duct temperatures are in a range of from about 460 to about 250° C. (880 to 480° F.). In the region upstream of location 250 and downstream of the furnace 208, the flue gas or duct temperature ranges from about 470 to about 250° C. (880 to 480° F.), and the halogens are present primarily in the form of the hydrogen species, HCl, HBr and HI. Conversion of the hydrogen species to a mixture of vapor HCl, HBr, and HI, respectively, are substantially complete in the zone downstream of the economizer section. However, studies have shown that conversion of Hg° to mercuric chloride and other oxidized mercury species proceeds within this zone but is not completed in this temperature range. The additive can be injected at location 250 as either a finely atomized liquid solution or blown into the duct as a finely divided powder. Configuration and spacing of the duct and the air preheater 216 is a factor at this location however. Tight spacing of flow channels (baskets) in the air preheater 216 may preclude injection at this point due to the potential for pressure drop increase from deposition-induced pluggage.

It is generally preferable to introduce the additive downstream of the air preheater 216, and as close as possible to the particulate control device 232, to avoid air preheater 216 pluggage and duct deposition. Location 254 represents addition of the mercury oxidation catalyst downstream of the air preheater 216 into the ductwork leading into the particulate control device (cold-side electrostatic precipitator or baghouse). This is the most preferred location since injection at this point presents the least risk of undesirable side effects. Duct temperature at this location range from about 190 to about 125° C. (375 to 260° F.). The additive can either be blown in as a finely divided powder or introduced as a finely atomized liquid spray that flash evaporates to yield an entrained spray solid that co-deposits with fly ash.

When an acid gas removal device 224, such as a flue gas desulfurization spray dryer absorber ("FGD SDA"), is present, location 254 is upstream of the particulate removal device 232 but downstream of the acid gas removal device 224. The temperature at this location is typically in a range of about 150 to about 100° C. (300 to 210° F.). This location 255 is a preferred injection point for the additive for this plant configuration. When introduced at this location, the additive preferably contains transition metal halide salts or metal nitrates as the additive metal.

When an acid gas removal device is located downstream of the particulate removal device 232, location 254 is upstream of the baghouse. The temperature at this location is typically in a range of about 150 to about 100° C. (300 to 210° F.). Location 254 is a preferred injection point for the mercury oxidation catalysts for this plant configuration. The transition metal halide salts or metal nitrates are particularly preferred for this location.

For location 254, the additive may be injected as finely atomized liquid solution or blown in as a finely divided powder according to the physical characteristics of the particular material and the duct configuration. For hygroscopic solids such as some halogen salts that are difficult to inject as a dry powder, liquid atomization is the preferred injection method. Liquid atomization requires a downstream section of duct free from obstructions in order to allow full evaporation of spray droplets. The present invention may use any suitable liquid flue gas conditioning injection systems or dry sorbent injection systems, such as those for activated carbon injection into coal-fired flue ducts, as well as any suitable system and method of material handling and conveyance.

The additive of the third formulation may be injected, according to the method and the plant configuration, at either of locations 250 and 254 for plants with no FGD scrubbing or at location 254 for plants with SDA followed by particulate control device (FF or cold-side ESP). The use of a transition metal halide salt impregnated onto an activated carbon sorbent is particularly preferred in the third formulation when flue gas HCl/HBr concentration is low or zero such as downstream of an SDA.

Another methodology for contacting the additive of the second formulation with the coal feed 200 will now be discussed with reference to FIG. 3. In the methodology, a bleed stream of flue gas, or other preheated gas, is used to carry one or more components of the additive into contact with the coal feed 200. The use of the flue gas can not only provide a more uniform distribution of selected additive component(s) on the coal feed 200 but also preheats the additive and coal feed 200 upstream of the furnace 208.

Figure 3:
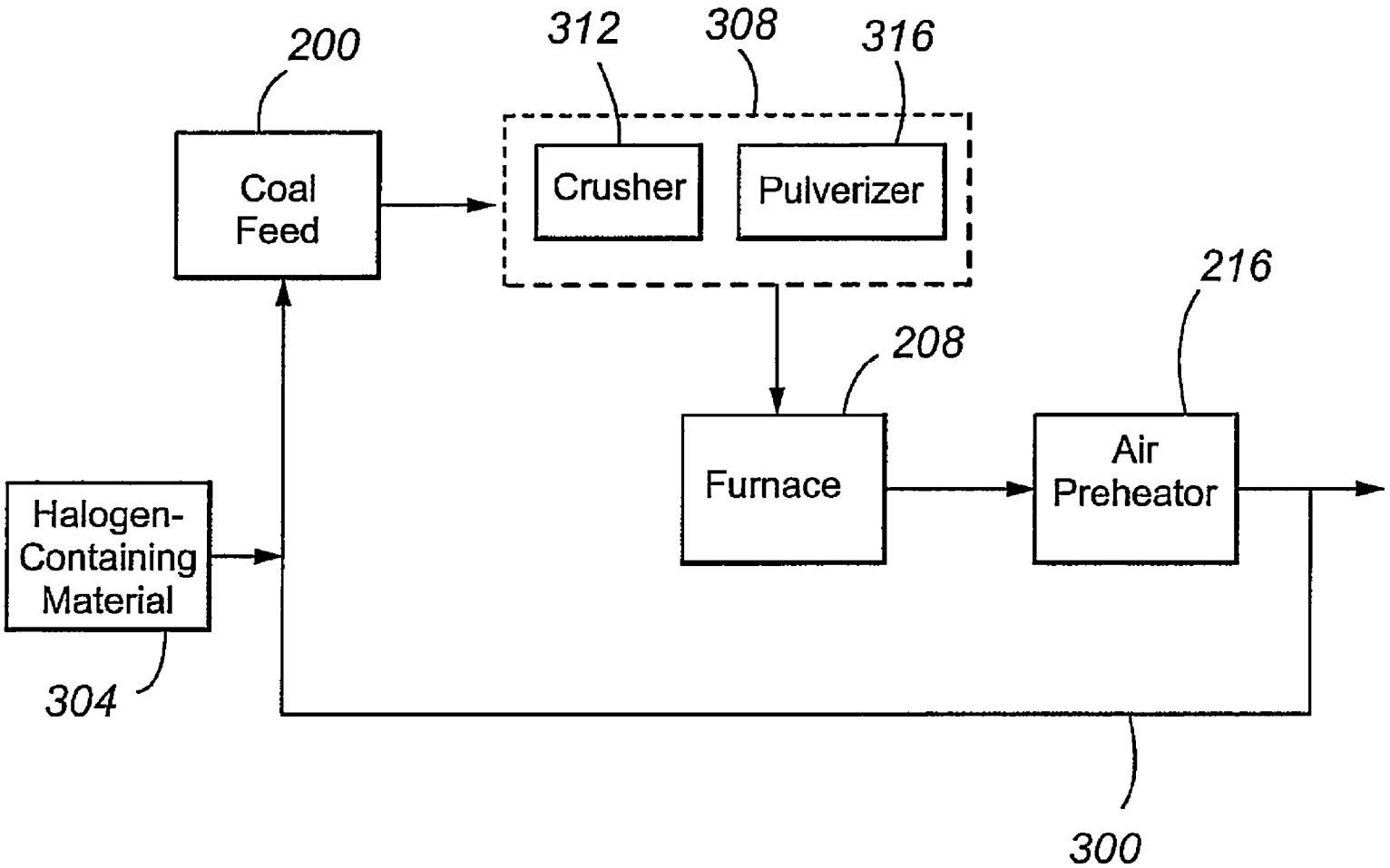
FIG. 3 is a block diagram of a coal feed treatment circuit according to an embodiment.

Referring to FIG. 3, a portion of the flue gas, from a point downstream of the air preheater 216, is removed from the main duct and redirected into contact with the coal feed 200. The point of removal from the main duct is selected such that the temperature of the flue gas 300 is less than the autoignition temperature of the coal feed 200. Preferably, the flue gas 300 temperature is no more than about 95% of the autoignition temperature, even more preferably no more than about 90% of the autoignition temperature, and even more preferably no more than about 85% of the autoignition temperature. In one configuration, the temperature of the flue gas 300 is preferably no more than about 250° F., even more preferably no more than about 200° F., and even more preferably no more than about 175° F. The additive, or a selected component thereof, is contacted with the redirected flue gas 300 at a point upstream of the point of contact with the coal feed 200. The particle size of the additive, or component thereof, is small enough to be entrained in the flue gas 300.

In a preferred configuration, the temperature of the flue gas 300 is at least the thermal decomposition temperature for a compound containing a selected additive component, whereby at least most of the selected additive component decomposes into a vapor-phase element in the flue gas 300. The thermal decomposition of the component into the flue gas 300 effects a more uniform distribution of the component on the feed coal 200. By way of example, in the configuration of FIG. 3 the selected additive component is a halogen-containing material, such as a halide salt. The temperature of the flue gas 300 is greater than the thermal decomposition temperature of the halogen-containing compound, e.g., halide salt. When the flue gas 300 has a temperature above the thermal decomposition temperature, the speciated chlorine and/or bromine in the halogen-containing material 304 will form vapor phase diatomic chlorine and/or bromine, respectively.

When the flue gas 300 contacts the coal feed 200, at least most of the vapor phase diatomic halogens will precipitate onto the surfaces of the coal particles, which are at a lower temperature than the flue gas 300. When the additive metal is present, the vapor phase diatomic halogen will typically deposit as a compound with the additive metal. For example, when iron is the additive metal, the precipitate will be a compound of the form $FeCl_2$ or $FeBr_2$. Preferably, for optimal results the coal particles, at the point of contact with the flue gas 300, are at a temperature less than the flue gas temperature and even more preferably less than the thermal decomposition temperature of the halogen. The remaining component(s) of the additive, for example the additive metal, is entrained and/or vaporized in the flue gas 300. Alternatively, the remaining component(s) may also be added to the coal feed 200 independently of the halogen-containing material 304. For example, the remaining component(s) may be added upstream or downstream of the point of contact with the flue gas 300.

In another configuration, the halogen-containing material 304, and optionally additive metal, is sprayed, in liquid form, into the redirected flue gas 300. The carrier liquid quickly volatilizes, leaving the halogen-containing material, and optionally additive metal, entrained, in particulate form, in the flue gas 300. Although sublimation is referenced in the prior configuration, it is to be understood that the additive transportation system of FIG. 3 is not limited to sublimation of an additive component. It may be used where the various additive components are entrained as fine particles in the flue gas 300.

After contact with the flue gas 300, the coal feed 200 is fed to the mill 308 and is reduced to a preferred size distribution.

Depending upon the final (comminuted) size distribution, the coal feed 200 is crushed in crusher 312 and/or pulverized in pulverizer 316.

Figure 7:
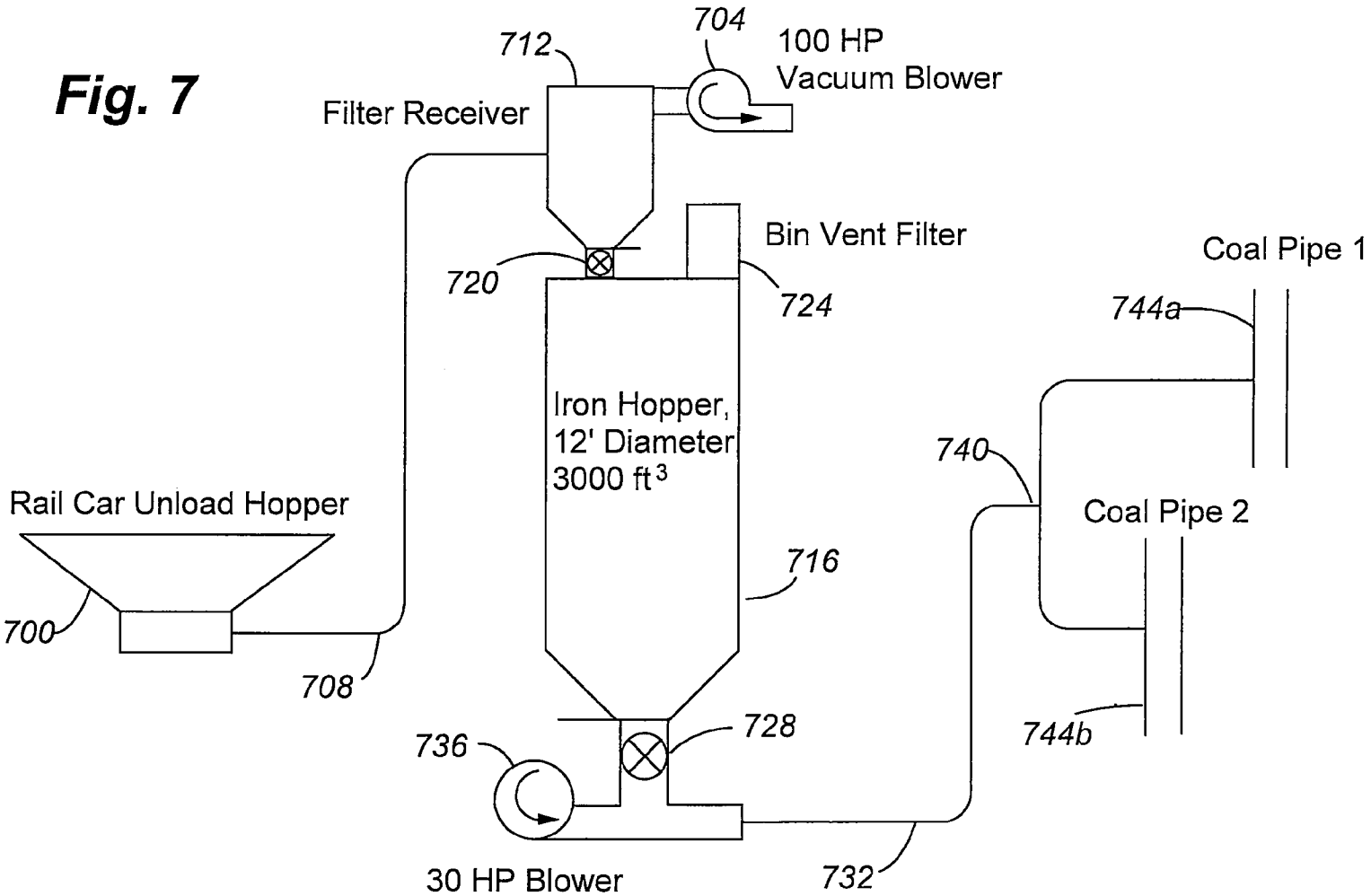
FIG. 7 is an embodiment of a flow schematic of a process using an additive according to one formulation.

FIG. 7 depicts a plant configuration according to another embodiment. Referring to FIG. 7, the additive is transported pneumatically from a hopper 700 of a covered railcar or truck using a vacuum blower 704 and transport line 708. The additive-containing gas stream passes through a filter receiver 712, which collects the additive as a retentate. The additive drops from the filter surface into the hopper 716 via duct 720. A bin vent filter 724 prevents pressure build up in the hopper 716 and accidental release of the additive from the hopper 716 into the ambient atmosphere. A metered valve 728 permits the additive to flow at a desired rate (typically from about 5 to about 2,000 lb./min.) into a feed line 732, where the additive is combined with pressurized air (via blower 736). The additive is entrained in the air and transported through splitter 740 and to a number of coal feed pipes 744*a,b*. The additive/air stream is combined with the coal/air stream passing through the coal feed pipes 744*a,b* to form feed mixtures for the furnace. The feed mixtures 744*a,b* are then introduced into the combustors via coal inlet 116 (FIG. 1).

The additive can be highly cohesive and have a tendency to form dense, hard deposits in the above-noted delivery system. A flow aid and/or abrasive material can be added to the material to aid in its handling. As used herein, a "flow aid" refers to any substance that reduces particle-to-particle attraction or sticking, such as through electrostatic or mechanical means. Preferred flow aids include ethylene glycol, "GRIND AIDS" manufactured by WR Grace Inc. The preferred amount of flow aid in the additive is at least about 1 and no more than about 10 wt. % (dry basis) and more preferably at least about 1 and no more than about 5 wt. % (dry basis). Abrasive materials can also be used to prevent deposit formation and/or life. As will be appreciated, abrasive materials will remove deposits from the conduit walls through abrasion. Any abrasive material may be employed, with preferred materials being sand, blasting grit, and/or boiler slag. The preferred amount of abrasive material in the additive is at least about 2 and no more than about 20 wt. % (dry basis) and more preferably at least about 2 and no more than about 10 wt. % (dry basis).

Using the additive, the slag layer in the coal-burning furnace typically includes:

(a) at least about 5 wt. % (dry basis) coal;

(b) iron in an amount of at least about 15 wt. % (dry basis); and (c) at least one mineralizer in an amount of at least about 1 wt. % (dry basis).

When the additive is employed, the slag layer in the combustor is in the form of a free-flowing liquid and typically has a viscosity of at least about 250 Poise.

Due to the presence of minerals in the feed material, the slag layer in the combustor can include other components. Examples include typically:

(d) from about 20 to about 35 wt. % (dry basis) silica oxides or $SiO_2$;

(e) from about 13 to about 20 wt. % (dry basis) aluminum oxides or $Al_2O_3$;

(f) from about 0 to about 2 wt. % (dry basis) titanium oxides or $TiO_2$;

(g) from about 18 to about 35 wt. % (dry basis) calcium oxides or CaO; and (h) from about 3 to about 10 wt. % (dry basis) magnesium oxides or MgO.

The solid byproduct of the coal combustion process is typically more saleable than the byproduct in the absence of the additive. The solid byproduct is typically harder than the other byproduct and has a highly desirable composition. Typically, the byproduct includes:

(a) at least about 20 wt. % (dry basis) silica;

(b) iron in an amount of at least about 15 wt. % (dry basis);

(c) mineralizer in an amount of at least about 1 wt. % (dry basis); and (d) at least about 13 wt % (dry basis) aluminum.

The byproduct can further include one or more of the compounds noted above.

Figure 8:
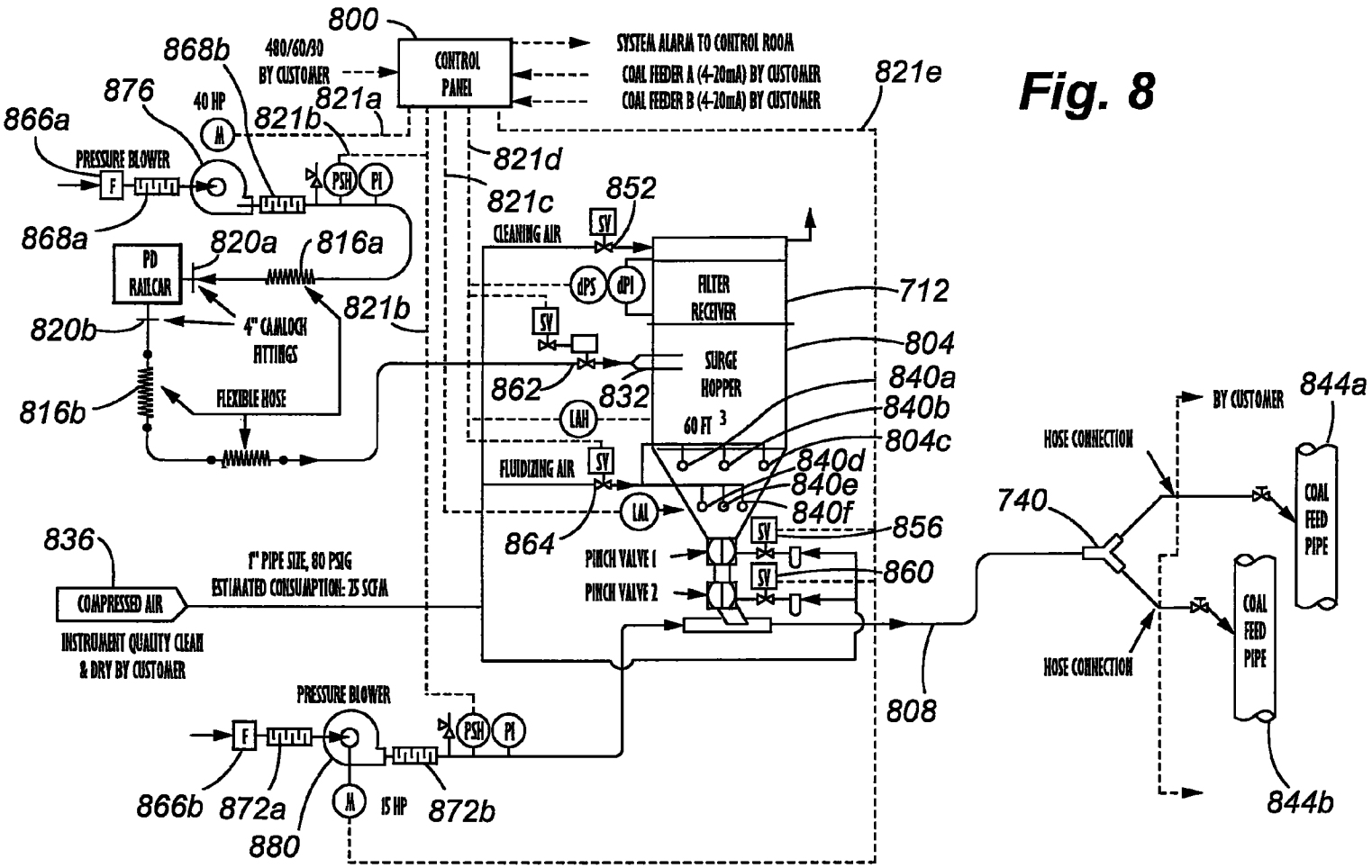
FIG. 8 is an embodiment of a flow schematic of a process using an additive according to one formulation.

Another plant configuration according to an embodiment is depicted in FIG. 8. Like reference numbers refer to the same components in FIG. 7. The process of FIG. 8 differs from the process of FIG. 7 in a number of respects. First, a controller 800 controls the feed rate of the additive from the hopper 804 to the transport conduit 808 and various other unit operations via control lines 821*a-e*. For additive feed rate, the controller 800 can use feed forward and/or feedback control. The feed forward control would be based upon the chemical analysis of the coal being fed from to the furnace. Typically, the chemical analysis would be based on the iron and/or ash content of the coal feed. Feedback control could come from a variety of measured characteristics of boiler operation and downstream components such as: LOI (flue gas $O_2$ and CO with a higher $O_2$ and/or CO concentration indicating less efficient combustion) as measured by an on-line furnace analyzer (not shown), carbon content in ash as determined from ash samples extracted from the flue gas or particle collector (e.g., electrostatic precipitator hopper) (the carbon content is indirectly proportional to combustion efficiency), furnace exit gas temperature (which will decrease with less coal carryover from the cyclones, slag optical characteristics such as emissivity or surface temperature (the above noted additive will desirably reduce emissivity and increase boiler heat transfer), slag tap flow monitoring to assure boiler operability, and stack opacity (a higher stack opacity equates to a less efficient combustion and vice versa). The controller 800 further monitors other boiler performance parameters (e.g., steam temperature and pressure, $NO_2$ emissions, et al.) through linkage to a boiler digital control system or DCS. In the event of system malfunction (as determined by a measured parameter falling below or exceeding predetermined threshholds in a look-up table), the controller 800 can forward an alarm signal to the control room and/or automatically shut down one or more unit operations.

The additive is removed from the railcar 700 via flexible hoses 816*a,b* with camlock fittings 820*a,b* using a pressured airstream produced by pressure blower 824. The pressurized airstream entrains the additive in the railcar and transports the additive via conduit 828 to the surge hopper 804 and introduced into the hopper in an input port 832 located in a mid-section of the hopper 804.

Compressed air 836 is introduced into a lower section of the hopper 804 via a plurality of air nozzles 840*a-f*. The additive bed (not shown) in the hopper 804 is therefore fluidized and maintained in a state of suspension to prevent the additive from forming a cohesive deposit in the hopper. The bed is therefore fluidized during injection of the additive into the coal feed lines 844*a,b*.

The compressed air 836 can be used to periodically clean the hopper 804 and filter 848 by opening valves 852, 856, and 860 and closing valves 862 and 864.

Filters 866*a,b* are located at the inlet of the blowers 876 and 880 to remove entrained material. Mufflers 868*a,b* and 872*a,b* are located at the inlet and outlet of the blowers 876 and 880 for noise suppression.

Finally, a number of abbreviations in FIG. 8 will be explained. "M" refers to the blower motors and an on/off switch to the motors, "PSH" to an in-line pressure sensor that transmits digital information to the controller 800, "PI" to a visual in-line pressure gauge, "dPS" to a differential pressure switch which transmits a digital signal to the controller indicating the pressure drop across filter receiver 712 (which compares the digital signal to a predetermined maximum desired pressure drop to determine when the filter receiver 712 requires cleaning), "dPI" to a visual differential pressure gauge measuring the pressure drop across the filter receiver 712, "LAH" to an upper level detector that senses when the additive is at a certain (upper) level in the hopper and transmits an alarm signal to the controller 800, "LAL" to a lower level detector that senses when the additive is at a certain (lower) level in the hopper and transmits an alarm signal to the controller 800, and "SV" to a solenoid valve that is actuated by an electrical signal from the controller 800.

EXPERIMENTAL

Two full-scale mercury control trials with iron and halogen addition to the coal feed of cyclone boilers firing PRB coal were performed.

Example 1

A four-day test was conducted on a coal-fired power plant with cyclone boilers firing Powder River Basin coal at a rate of 31 tons/hour. Baseline mercury emission as measured by EPA Method 324 (Sorbent Tube Method) over triplicate two-hour runs averaged 3.4 μg/dscm. The hopper fly ash bromine content for baseline conditions without additive was 21 ppmw. A combined additive consisting of an iron containing material with 98% ferric oxide content coated with a bromine containing alkaline salt was mixed into the coal feed. The addition rate was 5 lbs iron oxide per ton of coal and 0.06 pounds of bromine per ton of coal. The bromine increase in the flue gas was equivalent to a concentration of 15 ppmv. Unburned carbon from the first ESP collection field averaged 38.8% by weight of the total fly ash. The unburned carbon percentage in the front ESP field is biased high compared to unit average carbon due to preferential precipitation of the unburned carbon in the front field. Under these conditions with the additive in the coal the mercury emission at the unit stack was 0.37 μg/dscm for a 3 hour test. The fly ash mercury content was measured to be 1.78 ppmw. The fly ash bromine was measured to be 445 ppmw indicating that most of the added halogen reported to the ash. Bromine was not detected in the stack emissions during the additive injection based on two stack tests via the EPA Method 26A test method and was measured at 0.019 μg/dscm, slightly above the detection limit, during a third test. Total mercury removal relative to baseline was 89.1%.

Example 2

A multi-week test was conducted on a 150 MW coal fired power plant configured with cyclone furnaces and an electrostatic precipitator for particulate emission control. Each unit fired a Powder River Basin coal at an average rate of 89.2 tons/hour during full load. An iron containing material with 98% ferric oxide was added to the coal feed. The addition rate was 12.5 lbs iron oxide per ton of coal. In this instance, iron enrichment was required even during the baseline in order to control the slag viscosity while firing PRB coal. The baseline mercury emission on one of the two units as measured by EPA Method 324 (Sorbent Trap Method) over triplicate two-hour runs averaged 1.1 μg/dscm.

Unburned carbon from the first ESP collection field averaged 43% by weight of the total fly ash collected from the first field. The unburned carbon percentage in the front ESP field is biased high compared to unit average carbon due to preferential precipitation of the unburned carbon in the front field.

A combined additive consisting of an iron containing material with 98% ferric oxide content coated with a bromine containing alkaline salt was mixed into the coal feed. The addition rate was 12.5 lbs iron per ton of coal and 0.08 pounds of bromine per ton of coal. The bromine increase in the flue gas was equivalent to a concentration of 21 ppmv.

With the combined additive in the coal the mercury emission at the unit stack averaged 0.21 μg/dscm over a two-day period. The average mercury removal relative to baseline was 81%. The baseline mercury emission was notably low (1.1 μg/dscm concentration) compared to typical PRB plants. This was a result of the supplemental iron in the fly ash during baseline in combination with the high-unburned carbon content of the fly ash.

Example 3

The slag viscosity of a cyclone furnace was modeled and used to compare the effects of the additive without the additive. The elemental analysis of BOF flue dust was used as the additive. The slag viscosity model showed that the BOF flue dust, when added to the coal to increase the ash iron percentage to 30% by weight (dry basis), increased the thickness of the slag layer in the cyclone by about 60%.

The coal used in the model was based on the specifications for western coal, which is as follows:

Total ash=about 2-15% (dry basis) of the coal
$SiO_2$=about 20-35% (dry basis) of the ash
$Al_2O_3$=about 13-20% (dry basis) of the ash
$TiO_2$=about 0-2% (dry basis) of the ash
$Fe_2O_3$=about 3-10% (dry basis) of the ash
CaO=about 18-35% (dry basis) of the ash
MgO=about 3-10% (dry basis) of the ash
$Na_2O$=about 0-3% (dry basis) of the ash
$K_2O$=about 0-1% (dry basis) of the ash
$SO_3$/other=about 6-20% (dry basis) of the ash The model also showed that the temperature at which the ash would have a viscosity of 250 poise would be reduced by at least 100° F. The temperature is an important indicator of the minimum temperature at which the slag will flow. If the temperature at which the ash has a viscosity of 250 poise or lower is too high, then the slag will not flow to the slag tap on the floor of the boiler, and the slag will build up inside the boiler casing. This has been a problem on cyclone furnaces burning western coal at less than full design output.

Figure 4:
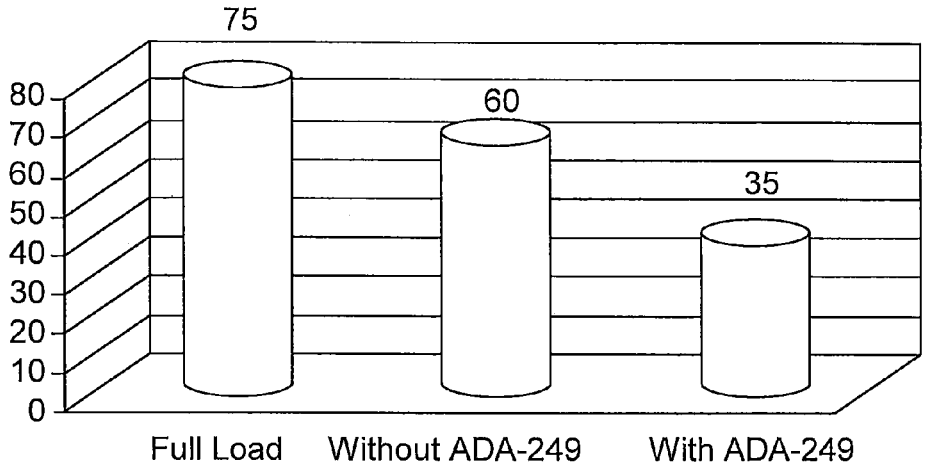
FIG. 4 is a chart of load (vertical axis) versus additive/no additive conditions (horizontal axis)

The first field test of the additive took place at a 75 MW unit in the midwest. A pneumatic storage and injection system was installed at the site, and boiler performance data was obtained during April of 2000. The changes in boiler operation were dramatic as shown in FIG. 4. In FIG. 4, "ADA-249" refers to the additive of the present invention.

Based on FIG. 4 and other experimental information, various observations may be made regarding the performance of ADA-249.

Minimum load was reduced from 75% to 47% of rated capacity when using only about 20 lb. of the additive per ton of coal.

The cost impact on load dispatch was about $200K/y, not counting the expected increase in unit availability from fewer shutdowns to clean the "monkey hole".

A high-temperature video camera also showed that the main furnace is clear when injecting the additive (meaning that the coal stays in the cyclone to burn) instead of hazy due to unburned fuel when no additive is injected.

The plant confirms that fly ash LOI is low and bottom ash is acceptable for high-value sale when the additive is on.

Figure 5:
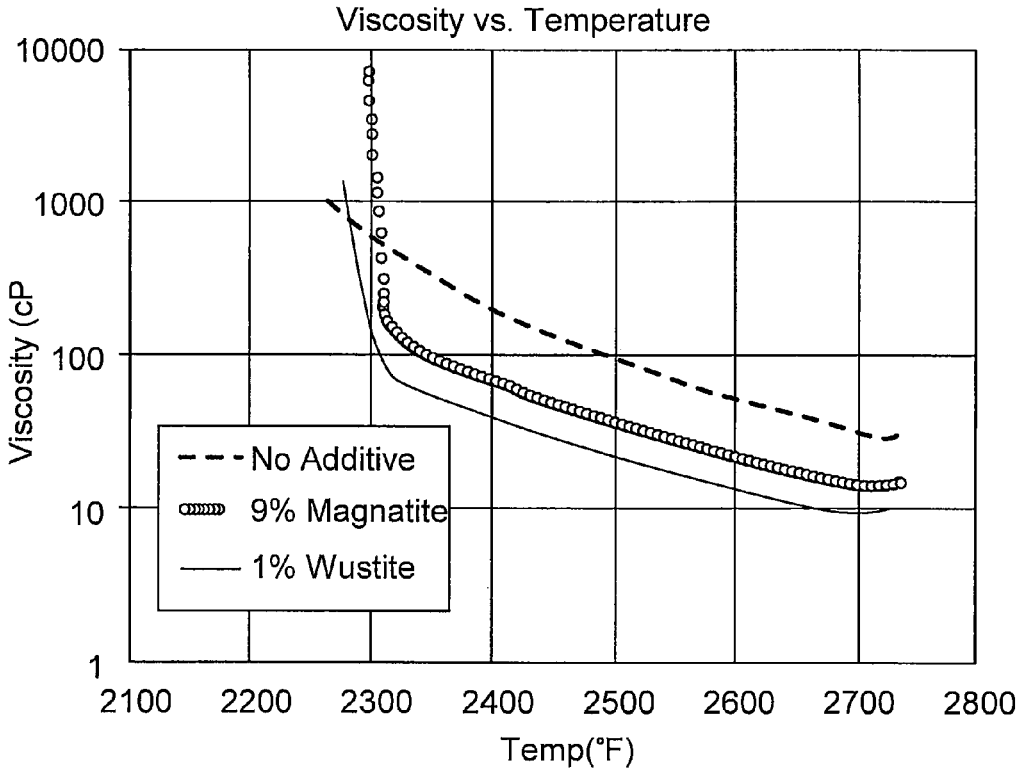
FIG. 5 is a plot of viscosity (Cp) (vertical axis) versus temperature (horizontal axis) for various experiments.

While all iron compounds will flux and thicken the slag layer when burning low-sulfur coals, the effects are improved by incorporating a blend of reduced iron compounds such as Wustite (FeO) and Magnetite ($Fe_3O_4$). FIG. 5 shows this effect. This figure shows temperature and viscosity data for a typical slag alone (shown as "No Additive"), compared to the same slag treated with 9 wt. % (of the slag (dry basis)) magnetite or 12 wt. % (of the slag (dry basis)) wustite at levels to give the same percent iron in the mixture. It can be seen that wustite allows slag flow at a lower temperature. Further, wustite contributes iron crystals to the melt (as indicated by the sharp rise in the curve) at a lower temperature. Wustite is comparatively rare in nature, but is a byproduct of the BOF processes.

Figure 6:
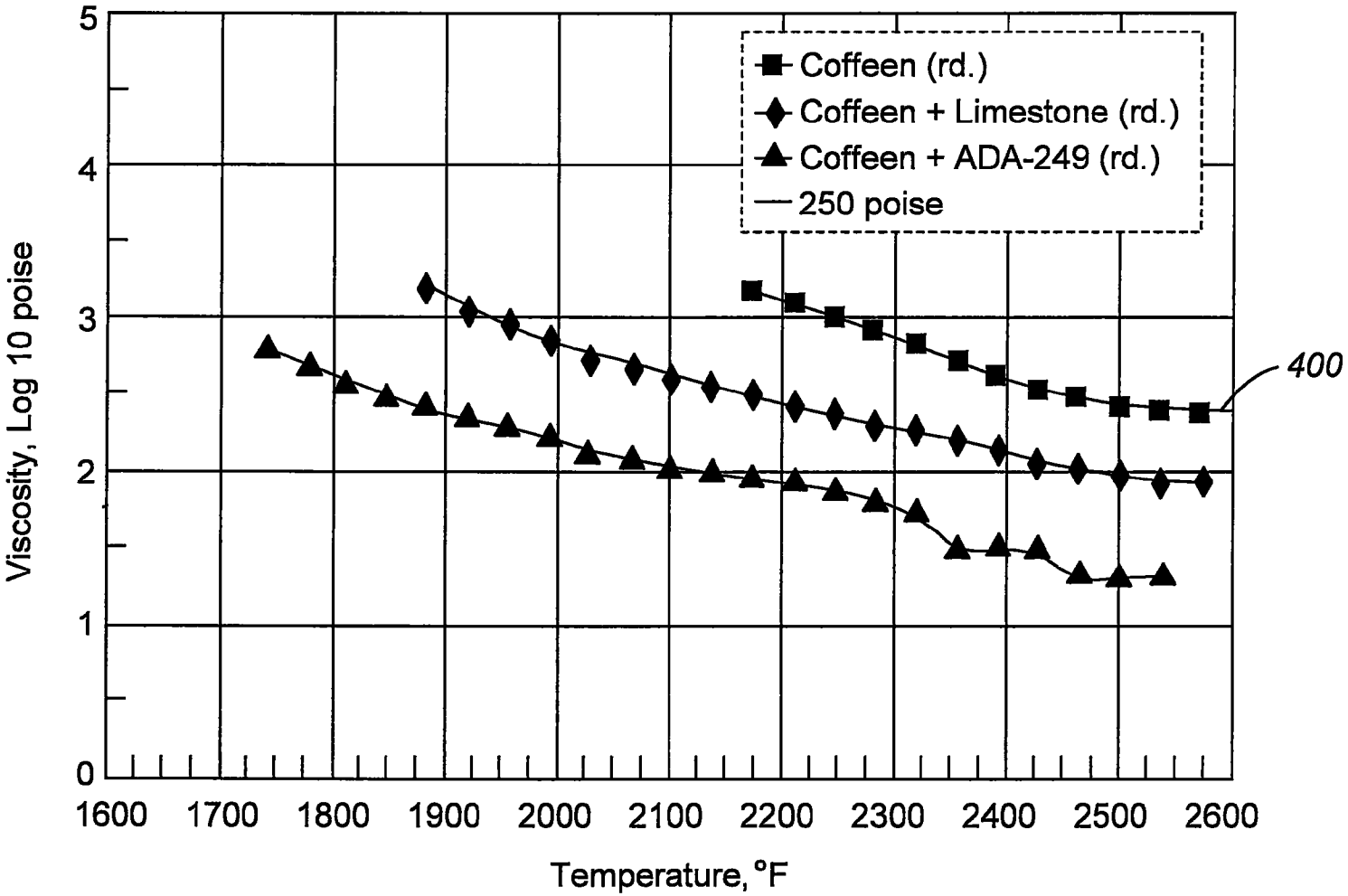
FIG. 6 is a plot of viscosity (Cp) (vertical axis) versus temperature (horizontal axis)

The present invention can also be applied to eastern low-sulfur coals having very high ash melting temperatures. FIG. 6 compares the viscosity-temperature relationships of coal slag alone (shown as "Coffeen (rd.)"), against the same coal slag treated with 2 percent limestone (shown as "Coffeen+ limestone (rd.)") or 2 percent of the additive (shown as "Coffeen+ADA-249 (rd.)"). The horizontal line 400 denotes the value of 250 poise. The basis for this comparison is the $T_{250}$, a slag characteristic used by fuel buyers to select the proper coal for cyclone furnaces. This value represents the temperature below which the slag will not flow out of the cyclone combustor.

The slag without additive has a $T_{250}$ of about 2,500° F., which is slightly higher than the maximum recommended $T_{250}$ of 2,450° F. By adding 2% limestone, the $T_{250}$ can be lowered into the acceptable range (around 2,200° F.). However, the same amount of the additive was able to reduce the $T_{250}$ to below 1,900° F. Looking at it another way, the $T_{250}$ coal requirement could be satisfied by adding half as much of the additive as limestone. Because of the increased effectiveness of the additive of the present invention, it becomes an economic alternative to limestone for eastern bituminous coals.

A number of variations and modifications of the invention can be used. It would be possible to provide for some features of the invention without providing others.

For example in one alternative embodiment, the different components of the additive can be added to the coal feed and/or flue gas at different locations and in different forms. For example, the halogen-containing material can be added, in the form of a halide or diatomic halogen, to the coal feed 200 while the additive metal-containing material can be added to the flue gas downstream of the furnace 208 in the form of an oxide.

In another alternative embodiment, the additive is used for carbonaceous combustion feed materials other than coal. The additive may be used for mercury control, for example, in high-temperature plants, such as waste incineration plants, for example, domestic waste, hazardous waste, and sewage incineration plants, cement burning plants or rotary kilns, and the like.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A composition, comprising:

a low sulfur and high alkali coal, the coal feed comprises less than about 1.5 wt. % sulfur (dry basis of the coal) and at least about 20 wt. % (dry basis of ash from the coal) alkali; and an additive comprising:

ferrous iron, ferric iron, wherein a ratio of ferric iron to ferrous iron in the additive is less than about 2:1; and a halogen-containing compound other than a chlorine compound, the additive comprising at least about 0.005 wt. % (dry basis of the additive) of the halogen-containing compound.

2. The composition of claim 1, wherein the coal feed has a Loss on Ignition ("LOI") of at least about 10% and comprises mercury and iron, and wherein the iron content of the coal feed is less than about 10 wt. % (dry basis of ash from the coal).

3. The composition of claim 1, wherein the coal comprises iron and wherein the iron content of the coal feed is less than about 10 wt. % (dry basis of ash from the coal).

4. The composition of claim 1, wherein the additive comprises no more than about 0.5 wt. % (dry basis of the additive) sulfur, wherein the composition comprises at least about 0.5 wt. % (dry basis of the composition) iron, wherein the composition comprises at least about 0.005 wt. % (dry basis of the composition) halogen-containing compound, and wherein the additive comprises at least about 50 wt. % (dry basis of the additive) iron.

5. The composition of claim 1, wherein the ratio ranges from about 0.1:1 to about 1.9:1 and wherein the additive comprises at least about 50 wt. % (dry basis of the additive) iron.

6. The composition of claim 1, wherein the additive comprises no more than about 66.5% iron in the form of ferric iron and wherein the additive comprises no more than about 0.1 wt. % (dry basis of the additive) sulfur.

7. The composition of claim 1, wherein at least about 10% of the iron is in the form of wustite.

8. The composition of claim 1, wherein the additive comprises at least about 1 wt. % of the halogen-containing compound and wherein at least about 33.5 wt. % (dry basis of the additive) of the iron in the additive is in the form of ferrous iron.

9. The composition of claim 7, wherein from about 15 to about 50% of the iron is in the form of wustite and wherein the additive comprises from about 0.5 to about 15 wt. % of the halogen-containing compound.

10. The composition of claim 9, wherein the halogen-containing compound comprises fluorine.

11. A composition, comprising:

(a) a low sulfur and high alkali coal, the coal feed comprises less than about 1.5 wt. % sulfur (dry basis of the coal) and at least about 20 wt. % (dry basis of ash from the coal) alkali; and (b) an additive comprising:

i) at least about 50 wt. % (dry basis of the additive) ferric and ferrous iron, ii) no more than about 0.5 wt. % sulfur (dry basis of the additive); and iii) at least about 0.1 wt. % (dry basis of the additive) halogen-containing compound other than a chlorine compound.

12. The composition of claim 11, wherein the coal feed has a Loss on Ignition ("LOI") of at least about 10%, wherein the coal feed comprises mercury and iron, wherein the iron content of the coal feed is less than about 10 wt. % (dry basis of ash from the coal), wherein the composition comprises at least about 0.5 wt. % (dry basis of the composition) iron, and wherein the composition comprises at least about 0.005 wt. % (dry basis of the composition) halogen-containing compound.

13. The composition of claim 11, wherein the coal comprises iron, wherein the iron content of the coal feed is less than about 10 wt. % (dry basis of ash from the coal), and wherein a ratio of ferric iron to ferrous iron in the additive is less than about 2:1.

14. The composition of claim 11, wherein the additive comprises no more than about 0.1 wt. % (dry basis of the additive) sulfur and wherein the additive comprises at least about 50 wt. % (dry basis) iron.

15. The composition of claim 13, wherein the ratio ranges from about 0.1:1 to about 1.9:1.

16. The composition of claim 11, wherein the additive comprises no more than about 66.5% iron in the form of ferric iron and wherein the additive comprises no more than about 0.1 wt. % sulfur (dry basis of the additive).

17. The composition of claim 11, wherein at least about 10% of the iron is in the form of wustite.

18. The composition of claim 11, wherein the additive comprises at least about 1 wt. % of the halogen-containing compound and wherein at least about 33.5 wt. % (dry basis of the additive) of the iron in the additive is in the form of ferrous iron.

19. The composition of claim 11, wherein from about 15 to about 50% of the iron is in the form of wustite and wherein the additive comprises from about 0.5 to about 15 wt. % of the halogen-containing compound.

20. The composition of claim 19, wherein the halogen-containing compound comprises fluorine and is substantially free of chlorine.

21. A composition, comprising:

a low sulfur and high alkali coal, the coal feed comprises less than about 1.5 wt. % sulfur (dry basis of the coal) and at least about 20 wt. % (dry basis of ash from the coal) alkali; and an additive comprising:

ferrous iron, ferric iron, and a halogen other than chlorine.

22. The composition of claim 21, wherein the halogen is in the form of a compound, wherein a ratio of ferric iron to ferrous iron in the additive is less than about 2:1, and wherein the additive comprises at least about 0.005 wt. % (dry basis of the additive) of the halogen-containing compound.

23. The composition of claim 21, wherein the coal feed has a Loss on Ignition ("LOI") of at least about 10% and comprises mercury and iron, and wherein the iron content of the coal feed is less than about 10 wt. % (dry basis of ash from the coal).

24. The composition of claim 21, wherein the coal comprises iron and wherein the iron content of the coal feed is less than about 10 wt. % (dry basis of ash from the coal).

25. The composition of claim 21, wherein the halogen is in the form of a compound, wherein the additive comprises no more than about 0.5 wt. % (dry basis of the additive) sulfur, wherein the composition comprises at least about 0.5 wt. % (dry basis of the composition) iron, wherein the composition comprises at least about 0.005 wt. % (dry basis of the composition) halogen-containing compound, and wherein the additive comprises at least about 50 wt. % (dry basis of the additive) iron.

26. The composition of claim 22, wherein the ratio ranges from about 0.1:1 to about 1.9:1 and wherein the additive comprises at least about 50 wt. % (dry basis of the additive) iron.

27. The composition of claim 22, wherein the additive comprises no more than about 66.5% iron in the form of ferric iron and wherein the additive comprises no more than about 0.1 wt. % (dry basis of the additive) sulfur.

28. The composition of claim 21, wherein at least about 10% of the iron is in the form of wustite.

29. The composition of claim 21, wherein the halogen is in the form of a compound, wherein the additive comprises at least about 1 wt. % of the halogen-containing compound and wherein at least about 33.5 wt. % (dry basis of the additive) of the iron in the additive is in the form of ferrous iron.

30. The composition of claim 21, wherein the halogen is in the form of a compound, wherein from about 15 to about 50% of the iron is in the form of wustite and wherein the additive comprises from about 0.5 to about 15 wt. % of the halogen-containing compound.

31. The composition of claim 21, wherein the halogen comprises fluorine.

32. A composition, comprising:

(a) a low sulfur and high alkali coal, the coal feed comprises less than about 1.5 wt. % sulfur (dry basis of the coal) and at least about 20 wt. % (dry basis of ash from the coal) alkali; and (b) an additive comprising:

i) ferric and ferrous iron, ii) no more than about 0.5 wt. % sulfur (dry basis of the additive); and iii) at least about 0.1 wt. % (dry basis of the additive) halogen-containing compound other than a chlorine compound.

33. The composition of claim 32, wherein the additive comprises at least about 50 wt. % (dry basis of the additive) ferric and ferrous iron, wherein the coal feed has a Loss on Ignition ("LOI") of at least about 10%, wherein the coal feed comprises mercury and iron, wherein the iron content of the coal feed is less than about 10 wt. % (dry basis of ash from the coal), wherein the composition comprises at least about 0.5 wt. % (dry basis of the composition) iron, and wherein the composition comprises at least about 0.005 wt. % (dry basis of the composition) halogen-containing compound.

34. The composition of claim 32, wherein the coal comprises iron, wherein the iron content of the coal feed is less than about 10 wt. % (dry basis of ash from the coal), and wherein a ratio of ferric iron to ferrous iron in the additive is less than about 2:1.

35. The composition of claim 32, wherein the additive comprises no more than about 0.1 wt. % (dry basis of the additive) sulfur and wherein the additive comprises at least about 50 wt. % (dry basis) iron.

36. The composition of claim 34, wherein the ratio ranges from about 0.1:1 to about 1.9:1.

37. The composition of claim 32, wherein the additive comprises no more than about 66.5% iron in the form of ferric iron and wherein the additive comprises no more than about 0.1 wt. % sulfur (dry basis of the additive).

38. The composition of claim 32, wherein at least about 10% of the iron is in the form of wustite.

39. The composition of claim 32, wherein the additive comprises at least about 1 wt. % of the halogen-containing compound and wherein at least about 33.5 wt. % (dry basis of the additive) of the iron in the additive is in the form of ferrous iron.

40. The composition of claim 38, wherein from about 15 to about 50% of the iron is in the form of wustite and wherein the additive comprises from about 0.5 to about 15 wt. % of the halogen-containing compound.

41. The composition of claim 40, wherein the halogen-containing compound comprises fluorine and is substantially free of chlorine.

* * * * *